US010662725B1

(12) United States Patent
Morelli et al.

(10) Patent No.: US 10,662,725 B1
(45) Date of Patent: May 26, 2020

(54) TUBULAR HANDLING APPARATUS AND METHODS

(71) Applicant: SUPERIOR RIG INNOVATIONS LTD., Innisfail (CA)

(72) Inventors: Nicholas Morelli, Red Deer (CA); Kurtis Keebler, Sylvan Lake (CA); Alvin W. Nicolay, Red Deer County (CA); James (Wes) Sveinson, Innisfail (CA); Jacob Thorkman, Red Deer County (CA)

(73) Assignee: Superior Rig Innovations Ltd. (CA)

( * ) Notice: Subject to any disclaimer, the term of this patent is extended or adjusted under 35 U.S.C. 154(b) by 0 days.

(21) Appl. No.: 16/180,108

(22) Filed: Nov. 5, 2018

(51) Int. Cl.
*E21B 19/14* (2006.01)
*E21B 19/15* (2006.01)

(52) U.S. Cl.
CPC ..... *E21B 19/155* (2013.01); *E21B 19/14* (2013.01)

(58) Field of Classification Search
CPC ..... E21B 15/003; E21B 19/08; E21B 19/14; E21B 19/15; E21B 19/155; E21B 19/20; E21B 7/023; E21B 15/04; B66F 11/00; B66F 7/08; B66F 7/0641; B66F 7/0691; B66F 7/0608; E04H 12/187; E04H 12/34; E04H 12/182
See application file for complete search history.

(56) References Cited

U.S. PATENT DOCUMENTS 889,148 A * 5/1908 Osyor ..... E21C 31/00 299/72
2,072,526 A * 3/1937 Morrison ..... E21C 11/00 173/44
2,395,075 A * 2/1946 Smith ..... B65G 41/002 198/318
2,577,926 A * 12/1951 Stiles ..... B65G 23/44 198/313
2,904,310 A * 9/1959 Leonard ..... E21B 7/023 173/27
3,708,024 A * 1/1973 Back ..... E21B 7/02 175/52
3,810,553 A 5/1974 Crocker et al.
4,359,207 A * 11/1982 Maryonovich ..... B66B 5/02 187/244
4,371,302 A 2/1983 Frias et al.
(Continued)

FOREIGN PATENT DOCUMENTS

CA 2222446 4/2005
CN 105545228 A 5/2016
WO 2017100921 A1 6/2017

*Primary Examiner* — Gregory W Adams
(74) *Attorney, Agent, or Firm* — Patrick Laycock; Rodman and Rodman LLP

(57) ABSTRACT

A tubular handling apparatus is provided comprising: a base; a lift carriage supported by the base; and a lift arm, pivotably connected to the base for raising and lowering the lift carriage. The apparatus further comprises a floating pivot mechanism coupling the lift arm to the lift carriage and having a position that is adjustable for collinear and independent axial movement along a longitudinal axis of the lift carriage and along a longitudinal axis of the lift arm. The lift arm and lift carriage each comprise a respective adjustment mechanism to actuate the collinear axial movement of the floating pivot mechanism position.

20 Claims, 25 Drawing Sheets

(56) References Cited

U.S. PATENT DOCUMENTS

| | | | | |
|---|---|---|---|---|
| 4,474,520 | A * | 10/1984 | Buckner | E21B 19/15 187/245 |
| 4,486,137 | A | 12/1984 | Buckner | |
| 4,684,314 | A | 8/1987 | Luth | |
| 4,739,868 | A * | 4/1988 | Head | B65G 41/002 198/316.1 |
| 4,893,387 | A | 1/1990 | Akamatsu et al. | |
| 5,498,086 | A | 3/1996 | Ou | |
| 6,059,460 | A | 5/2000 | Ono et al. | |
| 6,327,929 | B1 * | 12/2001 | Yanagisawa | B23Q 1/017 108/143 |
| 6,371,656 | B1 | 4/2002 | De Vries et al. | |
| 7,163,367 | B2 * | 1/2007 | Handley | E21B 19/155 405/166 |
| 7,316,367 | B2 | 1/2008 | Hiraguchi | |
| 7,404,697 | B2 | 7/2008 | Thompson | |
| 7,484,890 | B2 | 2/2009 | Ikeda et al. | |
| 7,883,309 | B2 | 2/2011 | Smith et al. | |
| 8,464,859 | B2 * | 6/2013 | Campbell | B65G 13/12 198/588 |
| 8,939,652 | B2 | 1/2015 | Peterson et al. | |
| 9,080,397 | B2 | 7/2015 | Ludwig | |
| 9,388,647 | B2 | 7/2016 | Dahmes et al. | |
| 9,759,259 | B2 | 9/2017 | Bauch et al. | |
| 2016/0319612 | A1 * | 11/2016 | Dahmes | E21B 19/14 |
| 2018/0179834 | A1 * | 6/2018 | Gordon | E21B 19/20 |

* cited by examiner

TUBULAR HANDLING APPARATUS AND METHODS

FIELD OF THE DISCLOSURE

This present disclosure relates to an apparatus for delivering lengths of pipe or other tubulars to and from an elevated platform such as the floor of a drilling rig, a service rig or an offshore rig.

BACKGROUND

During operations at a drilling rig, a service rig or an offshore rig, it is frequently necessary to move lengths of pipe (referred to as pipe joints) between the rig floor and a pipe storage area adjacent to the rig. A pipe joint may be moved to and from the rig floor by attaching a winch cable from a winch on the rig to the pipe joint and then raising or lowering the pipe joint using the rig winch. This procedure is time consuming and potentially dangerous for the rig crew.

Various apparatus and methods exist in the prior art which are directed at automating the procedure of moving pipe joints to and from the rig floor. A pipe handling apparatus of this type is frequently referred to as a "catwalk".

Some prior art pipe handling apparatus of the catwalk type and associated methods are described in U.S. Pat. No. 4,386,883 (Hogan et al); U.S. Pat. No. 4,403,898 (Thompson); U.S. Pat. No. 4,494,899 (Hoang et al); U.S. Pat. No. 6,994,505 (Hawkins); U.S. Pat. No. 7,163,367 (Handley); U.S. Pat. No. 8,016,536 (Gerber et al); U.S. Pat. No. 8,033,779 (Gerber et al); U.S. Pat. No. 8,052,368 (Littlewood et al); U.S. Pat. No. 8,215,887 (Fikowski et al); U.S. Patent Application Publication No. US 2005/0238463 (Smith); U.S. Patent Application Publication No. US 2008/0263990 (Morelli et al); U.S. Patent Application Publication No. US 201 1/0070054 (Crossley et al); U.S. Patent Application Publication No. US 2012/0027541 (Gerber et al); U.S. Patent Application Publication No. US 2012/0121364 (Taggart et al); Canadian Patent No. 2,224,638 (Morelli et al); Canadian Patent No. 2,431,213 (Handley et al); Canadian Patent No. 2,431,229 (Shiels et al); Canadian Patent No. 2,510,137 (Wells); Canadian Patent Application No. 2,476,109 (Smith); and Canadian Patent Application No. 2,713,676 (Crossley et al).

In conventional catwalk-type pipe handling apparatuses, a forward lifting assembly may typically by coupled to the lift carriage at a pivot point. The pivot point typically has a single defined position along the longitudinal axis of the lift carriage (at a point between the rear carriage end and the forward carriage end). Thus, while a forward lifting assembly may expand and retract, the overall range of positions possible for the forward carriage end may be limited.

Canadian Patent No. 2,444,446 describes a catwalk system comprising a boom and pivoting member. The boom and pivoting member define respective pluralities of ports, with each port of the boom being aligned with a corresponding port in the pivoting member when the boom is in a fully lowered position. Thus, when the boom is lowered, a pin may be placed in the desired pair of ports. Thus, the position of the pivot connection between the forward lifting assembly and the lift carriage is has a limited set of pre-defined positions available. The boom movement, thus, will be limited to a pre-defined, discrete set of arcs, with each arc corresponding to one of the pivot positions and rotation of the lift arm through its rotational range of motion. In addition, changing the selected pivot position may require first lowering the boom so that the pin may be safely removed and placed in a new position.

Thus, there is a need for improved apparatuses for handling pipes or other tubulars.

SUMMARY

According to an aspect, there is provided a tubular handling apparatus comprising: a base; a lift carriage supported by the base and having a carriage longitudinal axis, the lift carriage comprising a rear end and a forward end; a forward lifting assembly comprising a lift arm for raising and lowering the forward end of the lift carriage, the lift arm having an arm longitudinal axis and comprising a first arm end pivotably connected to the base; a floating pivot mechanism coupling the lift arm to the lift carriage; the lift arm comprising an arm axial adjustment mechanism coupled to the floating pivot mechanism and operable to move the floating pivot mechanism substantially parallel to the arm longitudinal axis to adjust a distance between the floating pivot mechanism and the first arm end; and the lift carriage comprising a carriage axial adjustment mechanism coupled to the floating pivot mechanism and operable to move the lift carriage relative to the floating pivot mechanism and substantially parallel to the carriage longitudinal axis.

In some embodiments, the base has a base longitudinal axis; and the carriage longitudinal axis, the arm longitudinal axis, and the base longitudinal axis are substantially coplanar.

In some embodiments, the arm axial adjustment mechanism and the carriage axial adjustment mechanism are independently actuatable.

In some embodiments, the forward lifting assembly further comprises a rotation actuation mechanism to pivot the lift arm with respect to the base.

In some embodiments, the floating pivot mechanism comprises: at least one lift carriage engaging element at least one lift arm engaging element; and a pivot connector coupling the at least one carriage engaging element and the at least one lift arm engaging element.

In some embodiments, the at least one lift carriage engaging element defines a passage therethough in which the pivot connector is received.

In some embodiments, each at least one lift arm engaging element defines a respective passage therethough in which the pivot connector is received.

In some embodiments, the at least one carriage engaging element is slidably engaged with the lift carriage and fixedly coupled to the carriage axial adjustment mechanism.

In some embodiments, the lift carriage further comprises at least one carriage guide track substantially parallel to the carriage longitudinal axis, wherein the at least one carriage engaging element comprises a carriage cart slidably engaged with the at least one carriage guide track.

In some embodiments, the at least one lift arm engaging element is slidably engaged with the lift arm and fixedly coupled to the arm axial adjustment mechanism.

In some embodiments, the lift arm further comprises at least one lift arm guide track that is substantially parallel with the arm longitudinal axis; wherein the at least one lift arm engaging element of the floating pivot mechanism comprises at least one lift arm cart slidably engaged with the at least one lift arm guide track.

In some embodiments: the lift carriage comprises a rigid elongate structure; the carriage axial adjustment mechanism is expandable and retractable; and the carriage axial adjustment mechanism and has a first end connected to the rigid elongate structure and a second end coupled to the floating pivot mechanism.

In some embodiments: the lift arm comprises a rigid arm support structure; the arm axial adjustment mechanism is expandable and retractable and has a first end connected to the arm support structure and a second end coupled to the floating pivot mechanism.

In some embodiments, at least one of the carriage axial adjustment mechanism and the arm axial adjustment mechanism each comprises a respective telescoping actuator.

In some embodiments, the apparatus further comprises a control system coupled to and operable to actuate the carriage axial adjustment mechanism, the arm axial adjustment mechanism, and the rotational adjustment mechanism.

In some embodiments, the control system comprises a processor that receives a selected position for the forward end of the lift carriage and calculates a configuration for at least one of the carriage axial adjustment mechanism, the arm axial adjustment mechanism, and the rotational adjustment mechanism as a function of the selected position.

In some embodiments, the control system actuates the at least one of the carriage axial adjustment mechanism, the arm axial adjustment mechanism, and the rotational adjustment mechanism in accordance with the calculated configuration.

According to an aspect, there is provided a method comprising: providing a lift carriage having a carriage longitudinal axis and comprising a carriage axial adjustment mechanism operable to actuate movement parallel to the carriage longitudinal axis; providing a forward lifting assembly comprising a lift arm, having an arm longitudinal axis, and an arm axial adjustment mechanism operable to actuate movement parallel to the carriage longitudinal axis; and coupling a floating pivot mechanism to the arm axial adjustment mechanism and the carriage axial adjustment mechanism such that: the arm axial adjustment mechanism is operable to move the floating pivot mechanism substantially parallel to the arm longitudinal axis to adjust a distance between the floating pivot mechanism and the first arm end the carriage axial adjustment mechanism is operable to move the lift carriage relative to the floating pivot mechanism and substantially parallel to the carriage longitudinal axis.

In some embodiments, the forward lifting assembly further comprises a rotation actuation mechanism, and the method further comprises: pivotably coupling the lift arm and the rotation actuation mechanism to a base for actuating rotation of the lift arm relative to the base to lift the end of the lift carriage.

According to an aspect, there is provided a lift carriage system for a tubular handling apparatus comprising a base, the lift carriage system comprising: a lift carriage supportable by the base and having a carriage longitudinal axis, the lift carriage comprising a rear end and a forward end; a forward lifting assembly comprising a lift arm for raising and lowering the forward end of the lift carriage, the lift arm having a first arm end pivotably connectable to the base; a floating pivot mechanism coupling the lift arm to the lift carriage; the lift arm comprising an arm axial adjustment mechanism coupled to the floating pivot mechanism and operable to move the floating pivot mechanism substantially parallel to the arm longitudinal axis to adjust a distance between the floating pivot mechanism and the first arm end; and the lift carriage comprising a carriage axial adjustment mechanism coupled to the floating pivot mechanism operable to move the lift carriage relative to the floating pivot mechanism and substantially parallel to the carriage longitudinal axis.

Other aspects and features of the present disclosure will become apparent, to those ordinarily skilled in the art, upon review of the following description of the specific embodiments of the disclosure.

BRIEF DESCRIPTION OF THE DRAWINGS

The present disclosure will be better understood having regard to the drawings in which.

DETAILED DESCRIPTION

Figure 1:
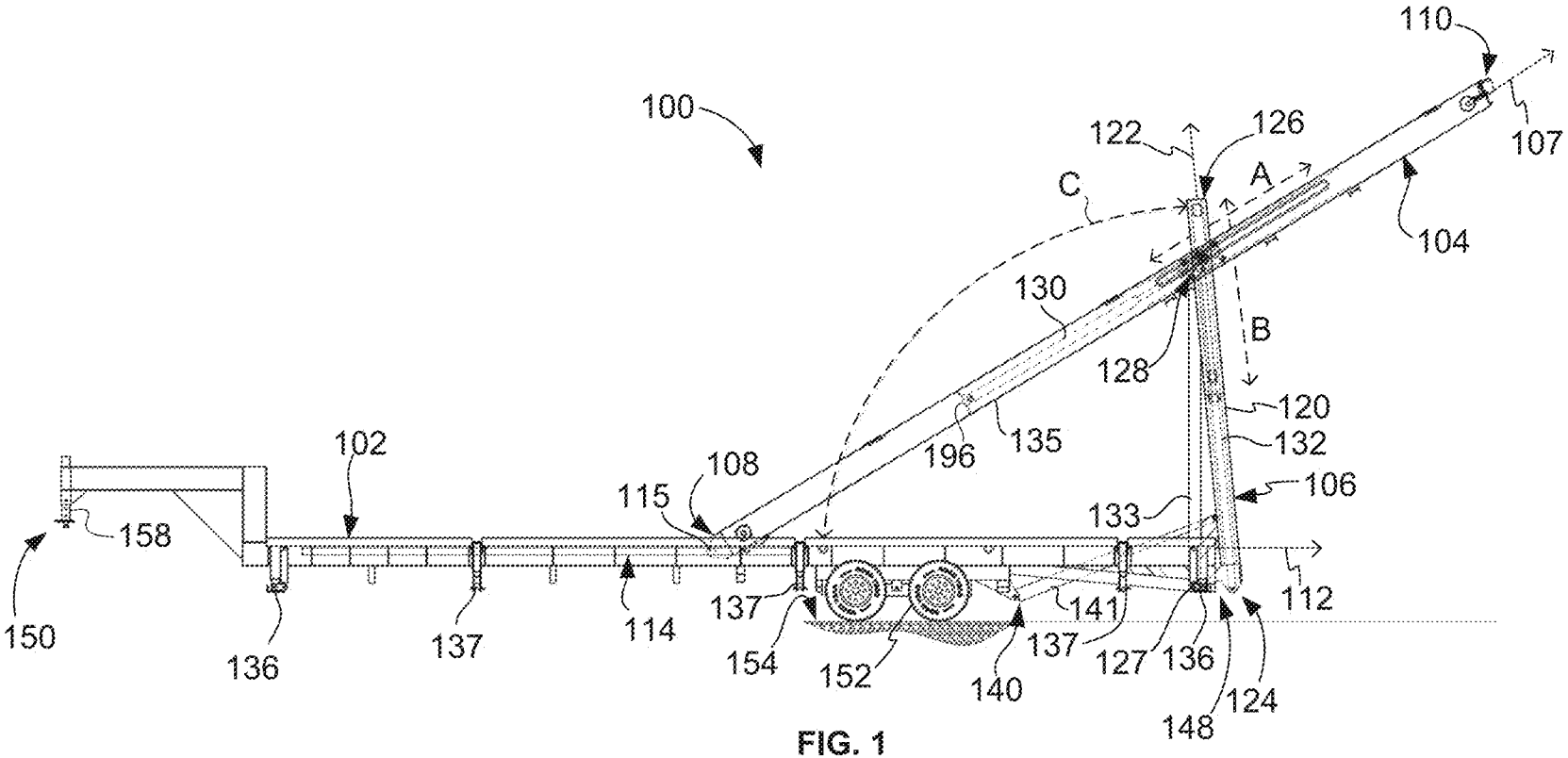
FIG. 1 is a side elevation view of a pipe handling apparatus according to some embodiments.

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

As used herein, "upper" and "lower" and "above" and "below" are relative to the normal orientation of the pipe handling apparatus during use. As one example, "lower" means relatively close to a bearing surface upon which the pipe handling apparatus rests and "upper" means relatively less close to a bearing surface upon which the pipe handling apparatus rests, so that "upper" is above "lower" relative to the bearing surface. As a second example, "above" means a direction away from the bearing surface and "below" means a direction toward the bearing surface. Similarly, the term "forward" in this disclosure generally refers to the direction generally toward the area to which the tubular handling apparatus may deliver segments of tubing (e.g. pipe segments), such as a derrick floor. However, such terms are not intended to limit the orientation of the apparatus in use, but rather to aid in description.

The terms "coupled to" and "engaged with" as used herein do not necessarily require a direct physical connection between two "coupled" or "engaged" elements. Unless expressly stated otherwise, these terms are to be understood as including indirect couplings between the two elements, possibly with one or more intermediate coupling elements.

As described above, conventional catwalk-type tubular handling apparatuses may provide limited ranges of availably lift carriage positions, thereby limiting the ability of the apparatus to adapt to a range of surface elevation differentials and apparatus positions.

A tubular handling apparatus according to some embodiments comprises a base, a lift carriage supported by the base, and a forward lifting assembly, comprising a lift arm, for lifting and lowering a forward end of the lift carriage. The lift carriage is coupled to the lift arm by a floating pivot mechanism having a position that is independently adjustable within a range along: (1) a longitudinal axis of the lift carriage; and (2) a longitudinal axis of the lift arm. The apparatus including the floating pivot mechanism described herein may provide a greater range of movement options of the lift carriage compared to conventional catwalk apparatuses.

The "base" may be any structure suitable for supporting the lift carriage, and the base may include a frame structure. The term "lift carriage" refers to any structure, typically elongated, which is suitable for delivering tubulars (e.g. pipe sections) from one location and height to another such as a boom, elongated conveyor, tubular conveying platform, etc. The tubulars may typically be sections of pipe, but other tubulars may also be handled and moved using the apparatus described herein. The "lift arm" may be any arm-like structure suitable to raise the lift carriage. The term "floating pivot mechanism" as used herein refers to a pivot connection mechanism that is adapted for its position to move relative to one or more coupled components. In this disclosure, the floating pivot mechanism position is movable with respect to both the lift arm and the lift carriage, as explained below. Example structures of these various components are described below with reference to the figures. However, it is to be understood that embodiments are not limited to the particular structure shown in the drawings.

The lift arm pivots or rotates with respect to the base in order to lift and lower the forward end of the lift carriage. The rotational movement of the lift arm, together with the two-way adjustment of the floating pivot mechanism position (relative to the lift carriage and lift arm) provides a wide range of movement of the forward end of the lift carriage. Thus, in contrast to previous catwalk designs that may only allow the pivot between a lift carriage and forward lifting assembly to move in a single or limited set of defined arcs, embodiments of the present disclosure may provide a more variable selection and continuous range of forward carriage end positions while possibly also minimizing effort and procedure for adjusting that position. The lift carriage typically comprises an elongated trough in which a tubular (e.g. section of pipe) may be placed to be conveyed.

The rear end of the lift carriage may be at or near the elevation of the base (e.g. near the ground level) and the forward end of the lift carriage may be raised to the height of an elevated platform, such as a rig floor. Typically, the rear end of the lift carriage is slidably engaged to the base and constrained to axial movement along the longitudinal axis of the base. The lift carriage may be used to transport the tubular to an elevated platform such as a rig or derrick floor. For example, the lift carriage may typically further comprise a conveyor mechanism, such as a skate, to move the pipe section along the trough for delivery to the elevated platform. This pipe handling apparatus according to some embodiments may be of a trailer or skid style as free-standing mobile equipment, or semi-stationary as part of the rig sub-structure.

Although embodiments may be described herein with reference to handling pipe sections, it is to be understood that the apparatus may also be used to handle and transport other tubulars. The apparatus may be suitable for use in other applications where one or more tubulars must be moved from a first elevation (e.g. ground level) to a second elevation (e.g. rig floor).

FIG. 1 is a side elevation view of a pipe handling apparatus 100 according to some embodiments.

The pipe handling apparatus 100 is comprised of a base 102, a lift carriage 104, and a forward lifting assembly 106 as major components. The lift carriage 104 and forward lifting assembly 106 are supported by the base 102, and, as described below, the forward lifting assembly 106 raises and lowers the lift carriage 104. The pipe handling apparatus 100 in this embodiment may be particularly suited for use in association with a service rig (not shown), but may also be used in other applications, such as with a drilling rig (not shown), an offshore rig (not shown), or a snubbing rig (not shown) in other embodiments. The forward lifting assembly 106 is shown in an extended position, and the lift carriage 104 is shown in a partially forward position, as will be explained in more detail below.

In this example embodiment, the base 102 is the principal structural component of the pipe handling apparatus 100, and supports and/or stores other components of the pipe handling apparatus 100. As non-limiting examples, the base 102 may include one or more toolboxes (not shown) and/or stow locations (not shown) and/or may provide routing and storage for electrical cables and hydraulic lines. In the exemplary embodiment of FIG. 1, the structural elements of the base 102 may be constructed of structural steel components, such as hollow structural section (HSS) and wide flange (WF) components. The base 102 transmits lifting forces to the ground. The frame may also contain any auxiliary tubular handling functions, a hydraulic power unit and/or means for controlling the system.

The lift carriage 104 has carriage longitudinal axis 107 and comprises a rear carriage end 108 and a forward carriage end 110. The lift carriage 104 also includes an elongated trough 116 (shown in FIG. 4) for holding sections of pipe (not shown). The life carriage 104 also typically includes a conveyor mechanism to convey a section of pipe currently in the trough 116 to the forward carriage end 110 for delivery to the rig floor (or other elevated platform). For example, the lift carriage 104 may comprise a skate mechanism (not shown) operable to push a section of pipe forward along the trough 116.

In this embodiment, the rear carriage end 108 is slidably engaged with the base 102 and restrained to movement substantially parallel to a base longitudinal axis 112 (which is typically substantially horizontal). More specifically, in this example, the rear carriage end 108 is slidably engaged to and restrained within track 114 of the base. The rear carriage end 108 in this example comprises cam rollers 115 engaged in the track 114. However, in other embodiments, the rear end of the lift carriage may not be engaged with the base directly. For example, in some embodiments, the rear carriage end 108 may instead be coupled to a rear lifting mechanism operable to lift the rear carriage end 108.

The forward lifting assembly 106 is connected between the lift carriage 104 and the base 102 and is configured for raising and lowering the forward end 110 of the lift carriage 104. The forward lifting assembly 106 comprises a lift arm 120 with an arm longitudinal axis 122. The lift arm 120 has a first arm end 124 pivotably connected to the base 102 by pivot connection 127. The lift arm 120 rotates or pivots with respect to the base 102 to raise and lower the lift carriage 104. Arcuate arrow "C" in FIG. 1 illustrates a possible rotational range of motion of the lift arm 120 between a lowered position of the lift arm 120 (see FIGS. 2 and 22) and a fully rotated or upright position (shown in FIG. 1). However, embodiments are not limited to this particular range of rotational movement.

In this example, the arm longitudinal axis 122, the base longitudinal axis 112, and the carriage longitudinal axis 107 are substantially coplanar.

The apparatus 100 also comprises a floating pivot mechanism 128 that couples the lift arm 120 of the forward lifting assembly 106 to the lift carriage 104. The position of the floating pivot mechanism 128 is independently adjustable for collinear movement along the carriage longitudinal axis 107 (as indicated by arrow "A") and along the arm longitudinal axis 122 (as indicated by arrow "B").

To actuate this two-way, collinear movement of the floating pivot mechanism 128, the apparatus 100 comprises a carriage axial adjustment mechanism 130 and an arm axial adjustment mechanism 132. The arm axial adjustment mechanism 132 is coupled to the floating pivot mechanism 128 and actuates movement of the floating pivot mechanism 128 substantially parallel to the arm longitudinal axis 122, thereby adjusting the distance between the floating pivot mechanism 128 and the first arm end 124. The carriage axial adjustment mechanism 130 is also coupled to the floating pivot mechanism 128 and actuates forward and reverse movement of the lift carriage 104 relative to the floating pivot mechanism, thereby moving the position of the floating pivot mechanism 128 along the carriage longitudinal axis 107.

The forward lifting assembly 106 in this embodiment further comprises a rotation actuation mechanism 140 to adjust a rotational position of the lift arm 120 with respect to the base 102 (as indicated by arrow "C" in FIG. 1). The rotation actuation mechanism 140 is a hydraulic cylinder 141 in this embodiment. However, any suitable actuation means for rotating the lift arm 120 may be used. For example, a pneumatic or electrically driven actuation device may be used in other embodiments. The lift arm 120 allows for the distribution of lifting and lateral forces.

The floating pivot mechanism 128 and the pivoting/rotational movement of the lift arm 120 together provide three independently actuatable movements for adjusting the lift carriage position. These movements include adjustment of: (1) the rotational position of the lift arm 120; (2) a distance between the floating pivot mechanism 128 and the first lift arm end 124; and (3) the position of the floating pivot mechanism 128 along the length of the lift carriage 104 (i.e. forward and reverse movement of the lift carriage relative to the floating pivot mechanism 128). The forward end 110 of the lift carriage 104 may, thus, be moved through a continuous range of possible positions (both height and reach) by utilizing these different adjustments.

The distance between the floating pivot mechanism 128 and the first lift arm end 124 (connected to the base 102) may be referred to as the "effective length" of the lift arm 120 herein. Thus, the "effective length" of the lift arm 120 may be increased or decreased by extending and retracting the arm axial adjustment mechanism 132. In this example embodiment, the arm axial adjustment mechanism 132 expands and retracts in a telescoping manner to actuate this movement. More specifically, in this example, the lift arm 120 comprises a rigid arm frame structure 133, and the arm axial adjustment mechanism 132 comprises hydraulic cylinders 200*a* and 200*b* (best shown in FIG. 5 to 8) connected to the arm frame structure 133 and the floating pivot mechanism 128. Embodiments are not limited to the use of hydraulic actuation devices. Any suitable mechanical actuation means may be used. The floating pivot mechanism 128 is slidably engaged with the lift arm 120 (specifically the arm frame structure 133) to allow axial movement of the floating pivot mechanism 128 relative to the lift arm 120 (i.e. movement parallel to the arm longitudinal axis 122). The arm adjustment mechanism 132 is controllable to selectively actuate that movement. The frame structure 133 is a support structure that substantially encloses and may protect and support the arm axial adjustment mechanism 130. Embodiments are not limited to the frame structure 133 shown in the drawings and described below, and other rigid support structures may be used to support the arm axial adjustment system 130 in other embodiments.

In this example embodiment, the carriage axial adjustment mechanism 130 expands and retracts in a telescoping manner to actuate the forward and reverse movement of the lift carriage 104. In this example, the lift carriage 104 comprises a, elongate rigid structure 135, which includes the trough 116 and sidewalls 159*a* and 159*b* best shown in FIG. 16. The carriage axial adjustment mechanism 130 is a hydraulic cylinder 190 (best shown in FIGS. 5 to 8) connected between the rigid carriage structure 135 and the floating pivot mechanism 128. Again, however, embodiments are not limited to the use of hydraulic actuation devices. The floating pivot mechanism 128 is slidably engaged with the lift carriage 104 (specifically with the rigid structure 135 of the lift carriage in this embodiment) to allow the position of the floating pivot mechanism 128 to be moved parallel to the carriage longitudinal axis 107. The carriage adjustment mechanism 130 is controllable to selectively actuate that movement.

In this embodiment, the base 102 is elongate and generally rectangular in shape and has a forward base end 148, a rear base end 150. The apparatus 100 in FIG. 1 is embodied in a trailer or skid style, being mounted on wheels 152 for engaging with a bearing surface 154 such as a ground surface, a slab, a deck, a skid, a trailer, etc. The example base 102 in FIG. 1 also includes an optional hitch 188 at the rear frame end 110 for hitching the base 102 to a towing vehicle (not shown). In other embodiments, the base 102 may sit directly on the bearing surface 154. For example, the base 102 may include feet for engaging the bearing surface 184 and/or leveling jacks to assist in leveling the pipe handling apparatus 100 in circumstances in which the bearing surface is not level. Example leveling jacks 136 are shown in FIG. 1. The jacks 136 may be hydraulically actuated, for example, and may be controlled by the hydraulic power unit and/or may be controlled manually. In other embodiments, the apparatus may be free-standing mobile equipment, or semi-stationary as part of the rig sub-structure, to name a few examples.

The base 102 may also include pipe rack indexers 137 as shown in FIG. 1. The pipe rack indexers 137 in this example are long arms that are hydraulically raised and lowered. Three pipe rack indexers 137 positioned on each side of the base 102 and face outwards. The pipe rack indexers 137 are designed to be lowered down and a section of pipe (or other tubular) may be rolled onto them. At that point hydraulics may lift the indexers 137 all at the same time and the section of pipe rolls into the trough. The Indexers 137 may also be used to lower a section of pipe (or other tubular) from the apparatus 100 to pipe racks (not shown). The Indexers 137 may, for example, be capable of lifting and lowering pipe onto pipe racks as low as 18 inches and as high as four feet above the bearing surface 154.

The lift carriage 104 may include optional kickers 138*a* and 138*b* (shown in FIG. 4) for moving a section of pipe (or other tubular) out of the trough 116 to be rolled onto the indexers 137.

Figure 2:
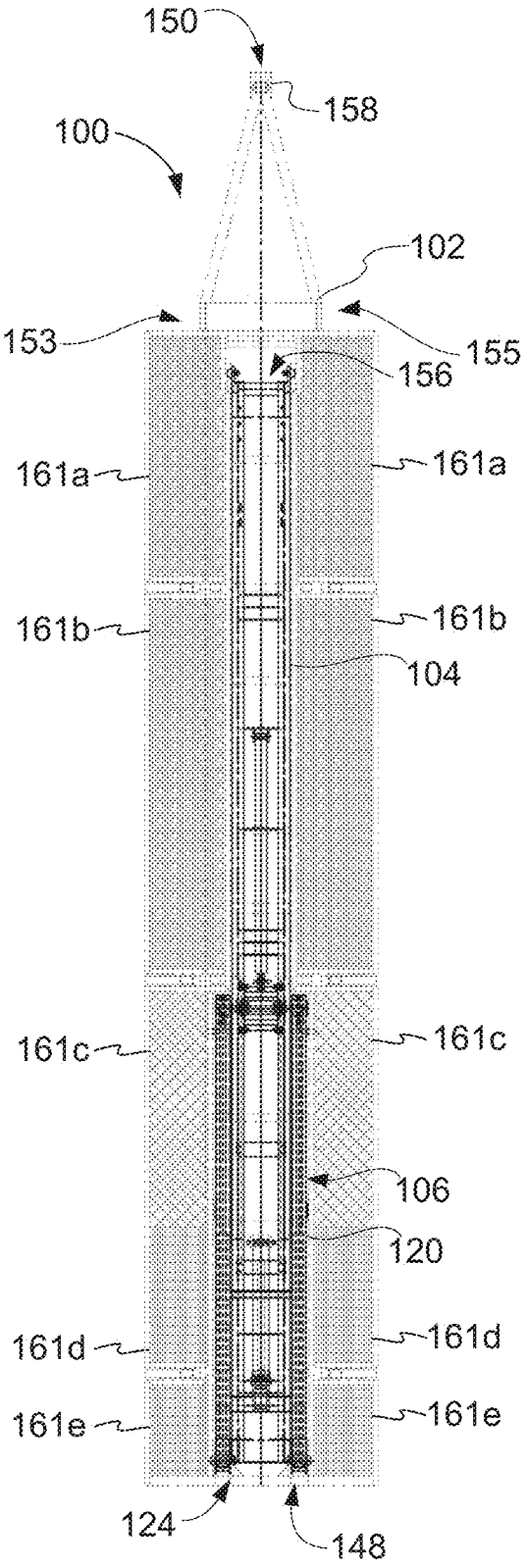
FIG. 2 is a top plan view of the apparatus of FIG. 1 in a fully lowered position.

FIG. 2 is a top plan view of the apparatus 100. The forward lifting assembly 106 and lift carriage 104 are shown in a fully lowered position in FIG. 2. The lift carriage 104 and lift arm 120 are both parallel with the base 102, with the lift arm 120 extending rearward from its first end 124. The base 102 defines a cavity 156 sized and shaped to receive the forward lifting assembly 106 and lift carriage 104 in this fully lowered position. The trough 116 (best shown in FIGS. 4 and 16) of the lift carriage 104 has been removed in FIG. 2 so that other components that would otherwise be hidden from view are visible.

The first arm end 124 of the lift arm 120 is pivotably connected to the base 102 near the base forward end 148. Embodiments are not limited to that position of the coupling between the lift arm 120 and the base 102.

In some embodiments, the apparatus 100 may further include or store a central hydraulic control and power unit (not shown) that provides hydraulic power for actuating various hydraulic components of the pipe handling apparatus 100. The hydraulic power unit may be comprised of typical hydraulic power components such as one or more motors, a hydraulic fluid reservoir, filters, a valve bank, etc. The central hydraulic power unit may be mounted to and/or stored in the base 102. However, embodiments of the disclosure are not limited to hydraulically driven actuation.

In other embodiments, power for actuating one or more components of the pipe handling apparatus 100 may be provided to the pipe handling apparatus 100 from one or more sources which are external or remote from the pipe handling apparatus 100. As non-limiting examples, electrical, pneumatic, mechanical and/or hydraulic power may be provided to the pipe handling apparatus 100 from a rig (e.g. a drilling rig, a service rig, a snubbing rig, etc.) and/or from an independent power source such as a generator.

In some embodiments, one or more components of the pipe handing apparatus 100 may be provided with dedicated power sources for actuating the components, and/or one or more components may share a dedicated power source.

Optional side platforms 161*a* to 161*e* are mounted to each of first and second sides 153 and 155 of the base 102 in this embodiment. The side platforms 161*a* to 161*e* may support one or more workers standing and/or walking thereon.

Figure 3:
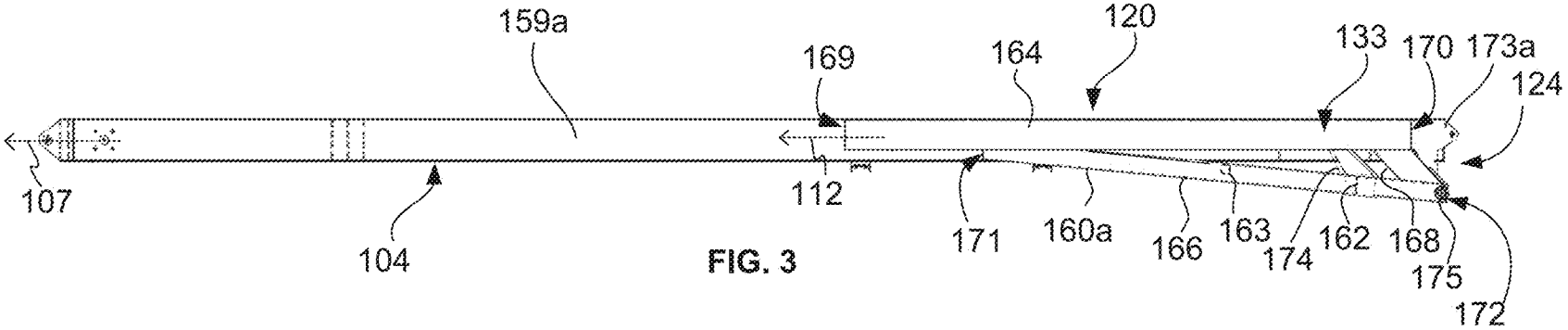
FIG. 3 is a side elevation view of a lift carriage and a lift arm of the apparatus of FIGS. 1 and 2.
Figure 4:
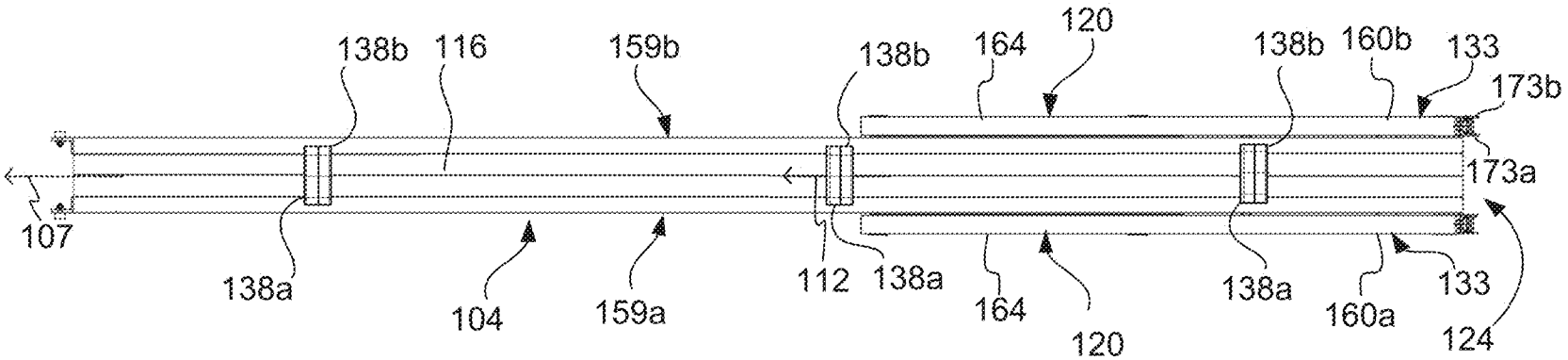
FIG. 4 is a top plan view of the lift carriage and the lift arm of FIG. 3.

FIG. 3 is a side elevation view of the lift carriage 104 and the lift arm 120 of FIGS. 1 and 2. FIG. 4 is a top plan view of the lift carriage 104 and the lift arm 120. In FIGS. 3 and 4, the lift carriage 104 and lift arm 120 are in the lowered position shown in FIG. 2.

The lift carriage 104 comprises the trough 116, first and second lift carriage side walls 159*a* and 159*b*, and the carriage axial adjustment mechanism 130 (not visible in FIGS. 3 and 4). The trough 116 is shaped and outfitted to hold/handle sections of pipe (or other tubulars). In this embodiment, the trough 116 has a generally V-shaped profile (see FIG. 22) and extends for substantially the length of the lift carriage 104. The trough 116 and side walls 159*a* and 159*b* are in the form of a weldment in this example. The trough 116 is configured to accommodate the sizes and lengths of pipe joints which are to be handled by the pipe handling apparatus 100. As will be appreciated, the sizes and lengths of pipe joints which to be handled in various applications may vary, and the lift carriage 104 (including the trough 116) of the apparatus 100 may be also vary accordingly.

The trough 116 is mounted on and supported by the first and second lift carriage side walls 159*a* and 159*b*, which are spaced apart and mirror each other. The side walls 159*a* and 159*b* and the trough 116 together form a rigid longitudinal structure of the lift carriage 104. The trough 116 and the first and second lift carriage side walls 159*a* and 159*b* collectively form the rigid structure 135 of the lift carriage 104 to which the carriage axial adjustment mechanism 130 is mounted, and with which the floating pivot mechanism 128 is slidably engaged. The carriage axial adjustment mechanism 130 is best shown in FIGS. 5 to 8 and is described in detail below.

The lift arm 120 comprises a rigid arm frame structure 133 and the lift arm axial adjustment mechanism 132 in this embodiment. The lift arm axial adjustment mechanism 132 (not visible in FIGS. 3 and 4) is best shown in FIGS. 5 to 8 and is described in detail below. The arm frame structure 133 is a rigid weldment in this example. The frame structure 133 may comprise structural steel components, such as hollow structural section (HSS), although embodiments are not limited to a particular material or arrangement of the arm frame structure 133.

The lift arm comprises first and second arm sections 160*a* and 160*b*, which are spaced apart and mirror each other. The first and second arm sections 160*a* and 160*b* are connected by first and second cross beams 162 and 163 (best shown in FIGS. 18B and 20). Embodiments are not limited to the two-section configuration of the lift arm 120. The lift arm in other embodiments may comprise a single arm section connected between the base and lift carriage.

For each arm section 160*a* and 160*b*, the arm frame structure 133 includes a main beam 164, an angled support beam 166, and the connector beam 168. Referring to FIG. 3, the main beam 164 is aligned with the arm longitudinal axis 122 and has opposite first and second ends 169 and 170. The angled support beam has a first end 171 attached to the main beam 164 at a point between the first and second main beam ends 169 and 170. The angled support beam also has a second end 172 positioned near the first arm end 124 of the lift arm 120. The connector beam 168 is connected between the main beam 164 and the angled support beam 166 near the first arm end 124. The angled support beam 168, thus, acts as a strut or brace for the lift arm 120 (similar to a triangular truss arrangement). The angled support beam 1866 defines a pivot hole 175 near the first arm end 124 for receiving a pin (not shown) to pivotably connect the arm 120 to the base 102 (FIG. 1). A bushing to receive a pivot pin (not shown) may be included in the pivot hole 175.

The first and second cross beams 162 and 163 are each connected between the angled support beams 166 of the first and second arm sections 160*a* and 160*b*. A bracket 174 extends at a forward and upward angle from the first cross beam 162. The bracket 174 connects to the telescoping actuator (piston) of the hydraulic cylinder 141 (FIG. 1), which actuates pivoting rotation of the lift arm 120. The first cross beam 162 is positioned a distance from the first arm end 124 of the lift arm 120 to provide sufficient leverage for the hydraulic cylinder 141 to rotate the lift arm 120. As shown in FIG. 1, the hydraulic cylinder 141 is connected to the base at a height below the connection point 127 of the lift arm 120 to the base 102, which also helps provide leverage for rotating the lift arm 120 away from its lowered position.

The frame structure 133 in this example also optionally includes a pair of plates 173*a* and 173*b* connected to each main beam 164. The plates 173*a* and 173*b* are connected at and extend from the second end 170 of the corresponding main beam 164. The Plates 173*a* and 173*b* may be mounted to the main beam 164 in any suitable manner (e.g. bolted, welded, etc.). Hydraulic cylinders 200*a* and 200*b* (see FIGS. 6 to 10) of the arm axial adjustment mechanism 132 are mounted to the plates 173*a* and 173*b*, as discussed in more detail below.

The lift arm and lift carriage structure described above is merely exemplary, and embodiment are not limited to this example. For example, the lift arm may comprise a single hollow beam with an axial adjustment means (e.g. one or more expandable/retractable lift) integrated therein. In other embodiments, the lift arm may simply comprise one or more expandable/retractable lifts connected between the base and the lift carriage. Many other arrangements are also possible. The structure of the lift carriage may likewise vary.

FIG. 4 also shows example trough kickers 138*a* and 138*b*, which are are designed to eject tubulars from the trough 116 so they can be rolled onto the Indexers 137 (FIG. 1) which then lower the tubulars onto pipe racks (not shown). In this example, the lift carriage 104 comprises six total kickers (138*a*, 138*b*) in the trough 116. Three kickers 138*a* are arranged to eject pipe to one side, while the other three kickers 138*b* are arranged to eject pipe to the other side of the lift carriage 104. The kickers 138*a* and 138*b* may be hydraulically actuated using a hydraulic cylinder. Like the indexers 137, a set of three kickers 138*a* or 138*b* move all at the same time. One difference between the kickers 138*a* and 138*b* and the indexers 137 is that, as soon as the kickers 138*a* and 138*b* have a default retracted position to which they retract when not actuated. In other words, when the means of actuating the hydraulics of the kickers (e.g. a valve handle or remote paddle) is released, the kickers 138*a* and 138*b* retract themselves to the default position.

Figure 5:
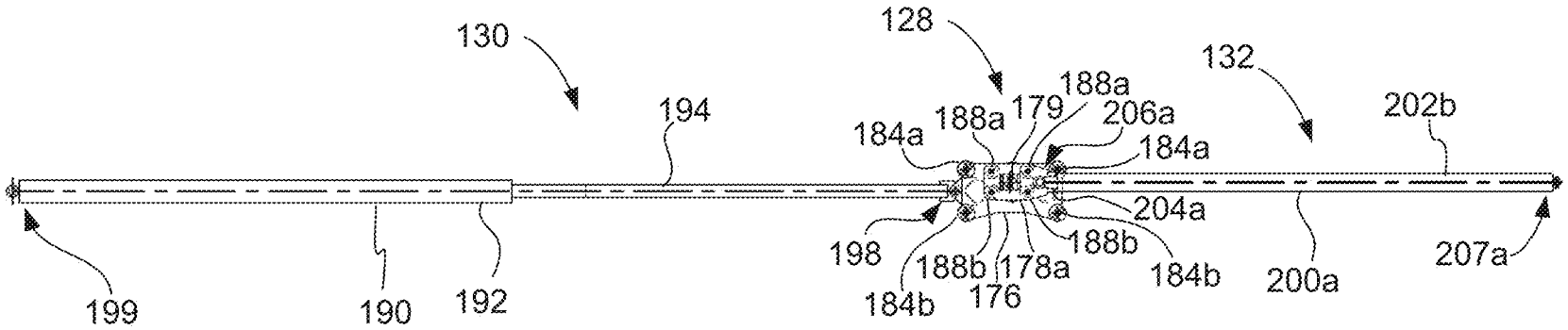
FIG. 5 is a side elevation view of a carriage axial adjustment mechanism, a lift arm axial adjustment mechanism and a floating pivot mechanism of the apparatus of FIGS. 1 and 2.
Figure 6:
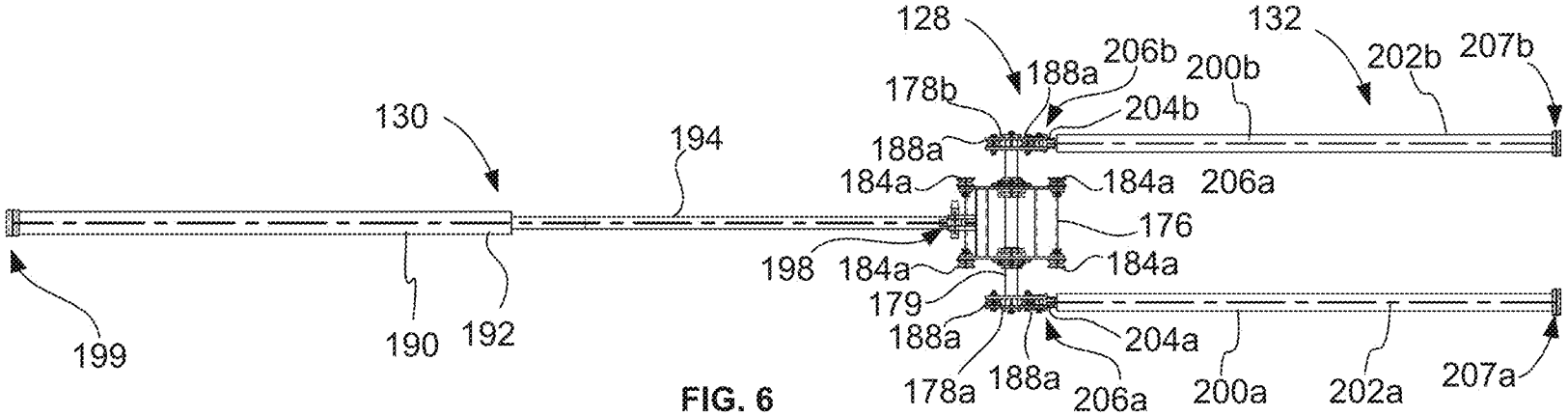
FIG. 6 is a top plan view of the carriage axial adjustment mechanism, the lift arm axial adjustment mechanism and the floating pivot mechanism of FIG. 5.

FIG. 5 is a side elevation view of the carriage axial adjustment mechanism 130, the lift arm axial adjustment mechanism 132 and the floating pivot mechanism 128 of the apparatus 100 of FIG. 1. FIG. 6 is a top plan view of the same. It is to be understood that the structure shown in FIGS. 5 and 6 is shown as an example only. The structure of the carriage axial adjustment mechanism 130, the lift arm axial adjustment mechanism 132 and the floating pivot mechanism 128 may vary in other embodiments.

In this example embodiment, the floating pivot mechanism 128 comprises a carriage cart 176 that engages with the lift carriage 104 (FIGS. 3 and 4), two arm carts 178*a* and 178*b* that engage with the lift arm 120 (FIGS. 3 and 4), and a pivot connector 179 coupling the carriage cart 176 and the arm carts 178*a* and 178*b*. The arm carts 178*a* and 178*b* and carriage cart 176 may, thus, pivot with respect to each other, about the pivot connector 179. Therefore, the lift carriage 104 and the lift arm 120 (FIGS. 1 to 4) are pivotably coupled by the floating pivot mechanism.

Embodiments are not limited to the particular carriage cart 176 and arm carts 178*a* and 178*b* shown. In other embodiments, rather than the carts (176, 178*a* and 178*b*), the floating pivot mechanism may comprise one or more different elements that engage the lift carriage 104 and the lift arm 120.

The pivot connector 179 in this example is in the form of a pivot pin that is received through each of the carriage cart 176 and the arm carts 178*a* and 178*b* to allow the carriage cart 176 to pivot with respect to the arm carts 178*a* and 178*b*, and vice versa, about a pivot axis 181 of the pivot connector 179.

Embodiments of the floating pivot mechanism are not limited to carts and/or pivot pin of this example. Any suitable means for providing a pivot connection that is moveable along two axes may also be used. The carts (176, 178*a* and 178*b*) connected by pin 179 are simply one exemplary embodiment.

The carriage cart 176 in this embodiment is slidably engaged with the lift carriage 104 and fixedly coupled to the carriage axial adjustment mechanism 130. In this example, as will be explained in more detail below, the carriage cart 176 comprises rollers 184*a* and 184*b* that engage guide tracks 180*a* and 180*b* (shown in FIGS. 14 to 16) in the lift carriage 104 to allow for the sliding movement of the carriage cart 176 parallel to the lift carriage longitudinal axis 107 (shown in FIGS. 1, 3 and 4).

The arm carts 178*a* and 178*b* are each slidably engaged with the lift arm 120 and fixedly coupled to the arm axial adjustment mechanism 132. In this example, as will be explained in more detail below, each arm cart 178*a* and 178*b* is slidably engaged with a respective one of the first arm second sections 160*a* and 160*b*. More particularly, each main beam 164 of the first and second arm sections 160*a* and 160*b* is hollow, having an interior space. The main beams 164 each have respective upper and lower guide tracks 188*a* and 188*b* mounted within their interior space, and the guide tracks 188*a* and 188*b* are engaged by rollers 184*a* and 184*b* of the corresponding arm cart 178*a* or 178*b*.

Embodiments are also not limited to the guide track/roller structure shown in FIGS. 5 and 6. More or fewer guide tracks may be used in other embodiments, and guide tracks may be integrated with the lift carriage in another manner. The arm carts may omit rolling elements. In some embodiments, rather than using rollers or other rolling elements, the carriage cart and/or arm carts may simply slide across a smooth surface such as plastic or hardened Ultra-high-molecular-weight polyethylene (UHMW) pads. Any method of slidably engaging the floating pivot mechanism may be used.

Embodiments are also not limited to the use of carts as elements that engage the lift carriage and lift arm. In some embodiments, rather than using carts, the pivot connector 179 may be directly coupled to the carriage axial adjustment mechanism 130 and the arm axial adjustment mechanism 132. For example, where the arm axial adjustment mechanism comprises a hydraulic cylinder, the pivot connector 179 may be connected to an end of the cylinder. As a more specific example, the pivot connector 179 could be received in a hole through a bracket at the end of the cylinder piston. The pivot connector 179 could optionally engage one or more guide slots in the lift arm to help support and/or guide the pivot connector through its axial movement relative to the lift arm. A similar arrangement could be used in the lift carriage. As another example, the floating pivot mechanism may comprise a pin that slides under the lift carriage trough and is raised to engage teeth under the trough at predetermined axial positions.

The pivot connector 179 may not be in the form of a pin in other embodiments. Any suitable pivot connection structure may be used. For example, rather than a pin received through a hole, a bearing pivot hinge or other pivot-type connection may be used.

In still other embodiments, other means may be used to allow sliding movement of a carriage engaging element (e.g. cart) and/or lift arm engaging element (e.g. cart) of the floating pivot mechanism. For example, a carriage engaging element may comprise a pin, and the lift carriage may comprise a guide slot, with the pin engaged with and constrained to movement within the guide slot. A similar slot/pin mechanism may be used to couple the floating pivot mechanism to the lift arm in other embodiments. Any suitable means to engage a pivot mechanism that allows collinear axial movement with respect to: (1) the lift arm; and (2) the lift carriage may be used in other embodiments.

As noted above, the carriage axial adjustment mechanism 130 actuates forward and reverse axial movement of the lift carriage 104 with respect to the floating pivot mechanism 128, and the arm axial adjustment mechanism 132 actuates axial movement of the floating pivot mechanism 128 with respect to the lift arm 120 (changing the effective length of the lift arm 120).

The carriage axial adjustment mechanism 130 in this embodiment comprises a hydraulic cylinder 190, although other non-hydraulic actuation devices may be used. The hydraulic cylinder 190 is connected between the rigid structure of the lift carriage 104 and the floating pivot mechanism 128. More specifically, the hydraulic cylinder 190 comprises a cylinder barrel 192 and a piston rod 194 that telescopes with the cylinder barrel 192 to expand and retract. The cylinder barrel 192 is connected to the plate 196 (shown in FIGS. 14 and 15) that is mounted between the side walls 159*a* and 159*b* and/or trough 116 of the lift carriage 104 (FIGS. 3 and 4). The piston rod 194 has a distal end 198 attached to the carriage cart 176, and an end 199 of the barrel (opposite to the piston rod 194) is attached to the plate 196.

Thus, extending the piston rod 194 causes the carriage cart 176 to move forward with respect to the lift carriage 104, while retracting the piston rod 194 moves the carriage cart 176 rearward with respect to the lift carriage 104. Or, from the perspective of the floating pivot mechanism 128, extending the piston rod 194 moves the lift carriage rearward, while retracting the piston rod 194 moves the lift carriage forward. The hydraulic cylinder 190 and carriage cart 176 are load bearing in this embodiment.

The arm axial adjustment mechanism 132 comprises two hydraulic cylinders 200*a* and 200*b*, one for each arm section 160*a* and 160*b*. Non-hydraulic actuation devices may be used in other embodiments. Each hydraulic cylinders 200*a* and 200*b* is connected between the arm frame structure 133 (FIGS. 3 and 4) of the lift arm 120 and the floating pivot mechanism 128. More specifically, each hydraulic cylinders 200*a* and 200*b* is mounted within one of the main beams 164 of one arm sections 160*a* and 160*b* and is connected to a respective one of the arm carts 178*a* and 178*b*. Each hydraulic cylinder 200*a* and 200*b* comprises a respective cylinder barrel 202*a* or 202*b* and a respective piston rod 204*a* or 204*b* that telescopes with the corresponding cylinder barrel 202*a* or 202*b* to expand and retract as controlled by a control means. The control means may, for example, be a hydraulic control, an electric over hydraulic control (e.g. a, electric remote used to control hydraulic functions) or any other suitable method for controlling hydraulic cylinders. The piston rods 204*a* and 204*b* (best shown in FIG. 8) each have a respective distal end 206*a* or 206*b* affixed to the corresponding arm cart 178*a* or 178*b*. The cylinder barrels 202*a* and 202*b* each have a respective end 207*a* or 207*b* (opposite to the piston rods 204*a* and 204*b*) that is affixed to the first end 169 of the main beam 164 of the corresponding arm section 160*a* and 160*b*. The hydraulic cylinders 200*a* and 200*b* are load bearing in this embodiment.

In other embodiments, the lift arm may also not comprise a frame structure separate from its axial adjustment mechanism. For example, the lift arm may simply consist of one or more lifts connected between the base and lift carriage. The lifts may comprise telescoping lifts and may be driven by any suitable means (e.g. hydraulic, pneumatic, electrical, etc.).

With reference to FIG. 1, the hydraulic cylinder 141 (i.e. the rotation actuation mechanism 140 of the forward lifting assembly 106) also includes a cylinder barrel and telescoping piston rod. The piston rod of the hydraulic cylinder 141 is controllable to expand and retract. The piston rod connects at its distal end to the bracket 174 (FIG. 3) mounted on the first cross beam 162 (FIG. 3) of the lift arm 120. The end of the cylinder barrel opposite to the piston is pivotably connected to the base 102.

Figure 25:
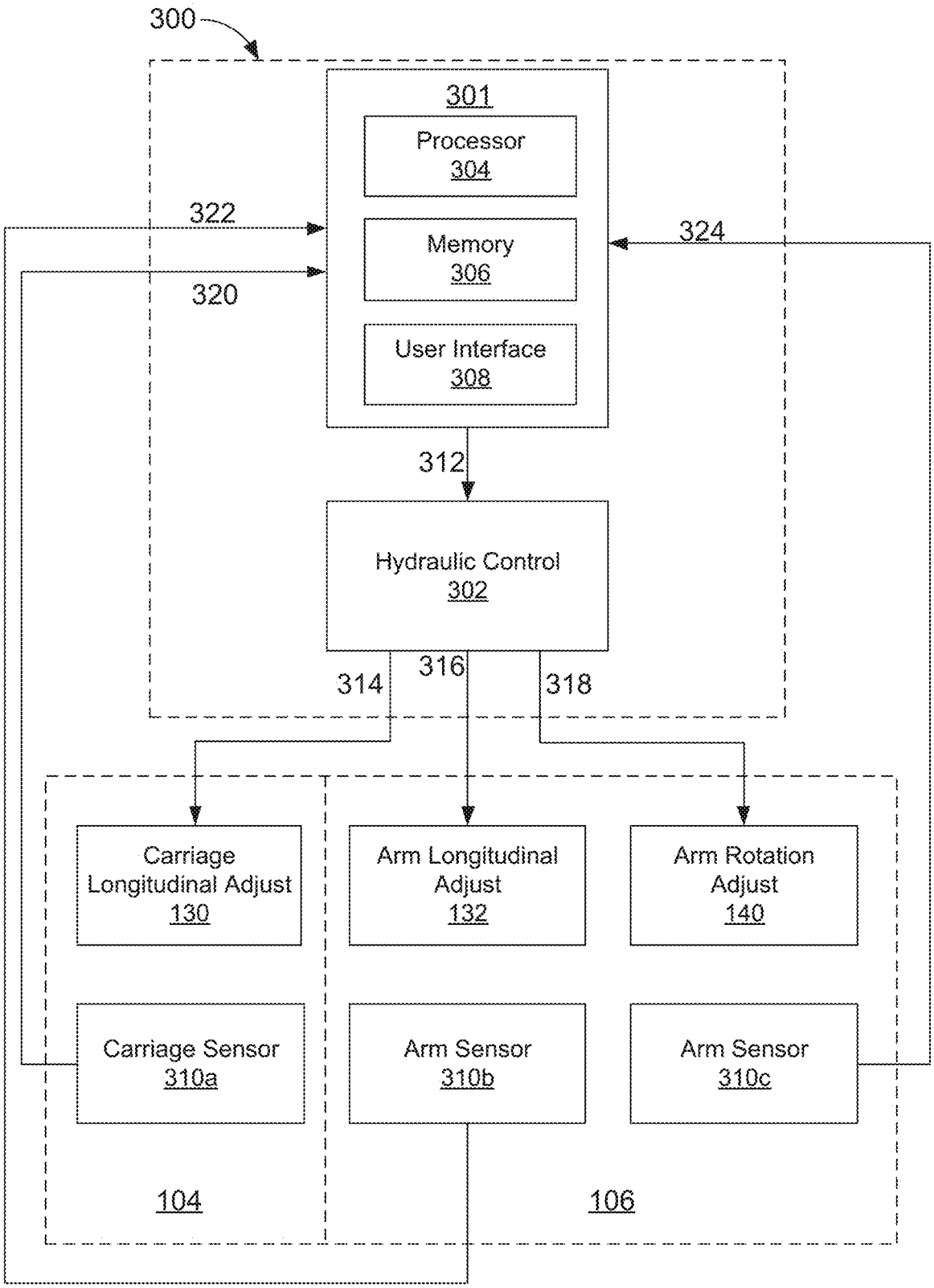
FIG. 25 is a block diagram of an example control system for the tubular handling apparatus of FIGS. 1 and 22 to 24, according to some embodiments.

Each of the hydraulic cylinders 141, 190, 200*a* and 200*b* may be independently controlled, to expand and retract, by a hydraulic control such as the hydraulic control module 302 shown in FIG. 25. Each arm hydraulic cylinder 141, 190, 200*a* and 200*b* can be set in any position within its respective range of actuation. Optionally, one or more locking mechanism (not shown) may be additionally included and engaged to help hold the desired position of the lift carriage 104 and lift arm 120.

With reference again to FIGS. 5 and 6, the hydraulic cylinder 190 of the lift carriage 104 (i.e. the carriage axial adjustment mechanism 130) is shown in a fully extended position. The hydraulic cylinders 200*a* and 200*b* of the forward lifting assembly 106 (i.e. the arm axial adjustment mechanism 132) are shown in their fully retracted position.

Figure 7:
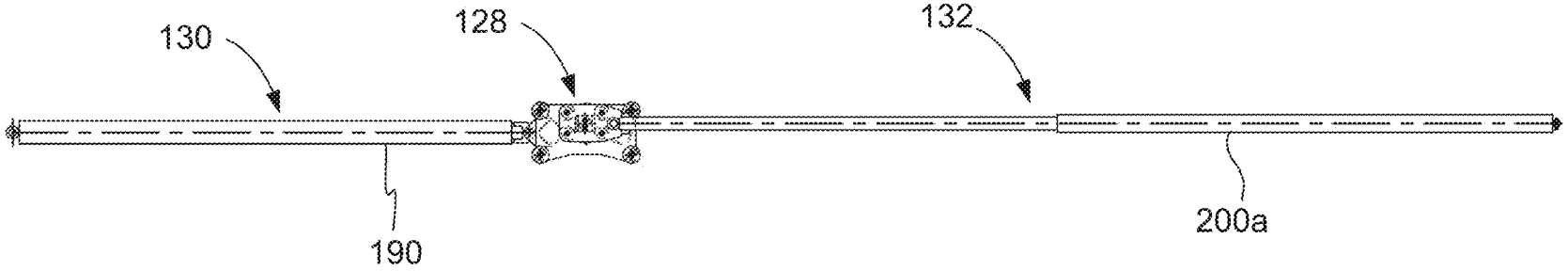
FIG. 7 is another side elevation view of a carriage axial adjustment mechanism, a lift arm axial adjustment mechanism and a floating pivot mechanism of FIGS. 5 and 6.
Figure 8:
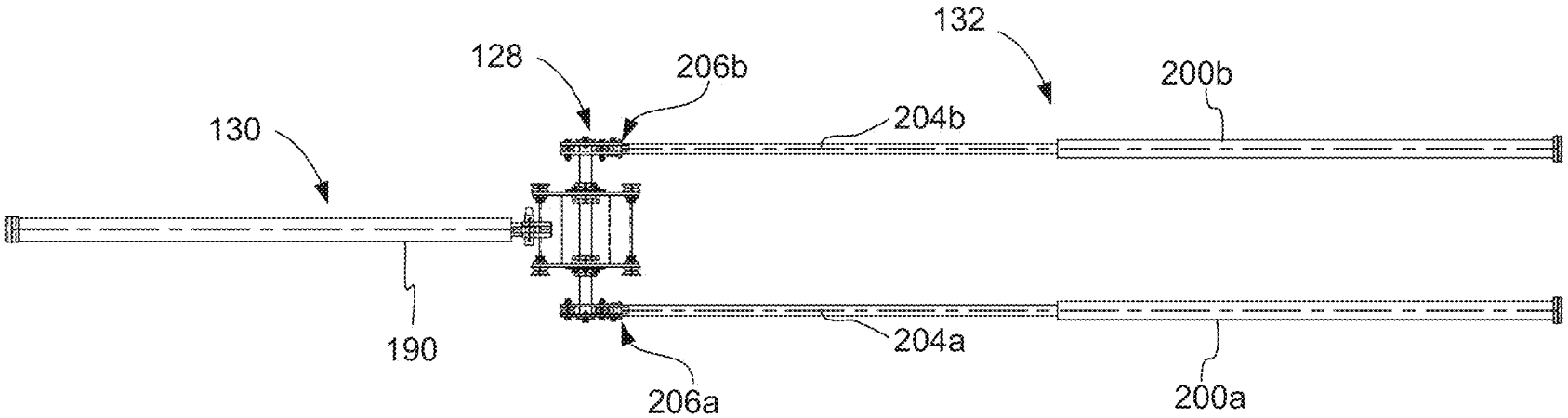
FIG. 8 is another top plan view of the carriage axial adjustment mechanism, the lift arm axial adjustment mechanism and the floating pivot mechanism of FIGS. 5 to 7.

FIGS. 7 and 8 show the same views as FIGS. 5 and 6, but with the hydraulic cylinder 190 of the lift carriage 104 in the fully retracted position, and the hydraulic cylinders 200*a* and 200*b* of the lift arm 120 shown in their fully extended position. The carriage axial adjustment mechanism 130 and the arm axial adjustment mechanism 132 are independently actuatable, and they are each continuously and selectively adjustable through their respective ranges of motion.

Figure 9:
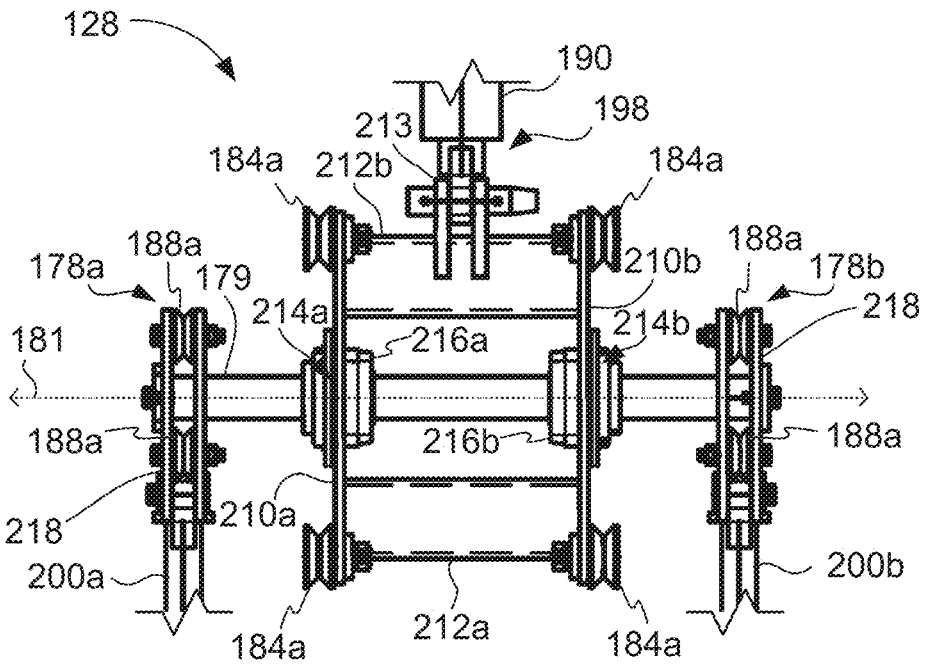
FIG. 9 is an enlarged top plan view of the floating pivot mechanism of FIGS. 5 to 8.
Figure 10:
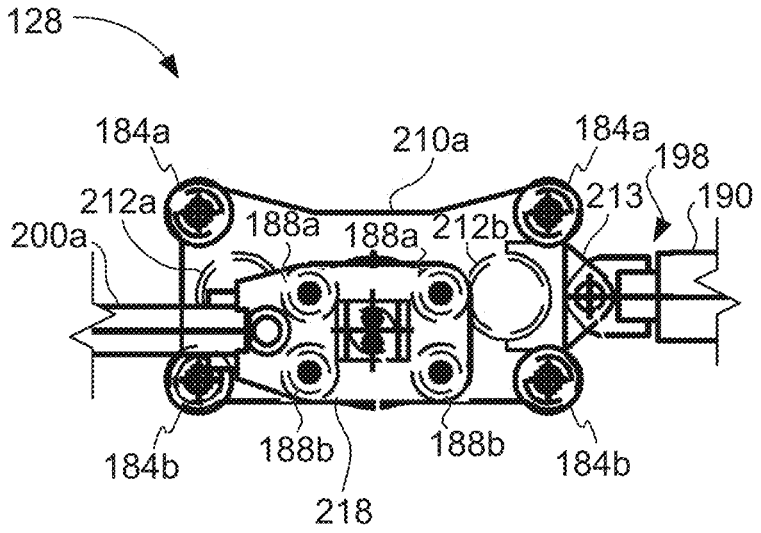
FIG. 10 is an enlarged side elevation view of the floating pivot mechanism of FIGS. 5 to 9.

FIG. 9 is an enlarged top plan view of the floating pivot mechanism 128 shown in FIGS. 5 to 8. FIG. 10 is an enlarged side elevation view of the floating pivot mechanism 128. The hydraulic cylinders 190, 200*a* and 200*b* connected to the floating pivot mechanism 128 are partially shown in FIGS. 9 and 10.

As shown, the carriage cart 176 comprises first and second spaced apart plates 210*a* and 210*b*, and forward and rear tubular beams 212*a* and 212*b* interconnecting the plates 210*a* and 210*b*. The plates 210*a* and 210*b* are generally parallel to each other. Each plate 210*a* and 210*b* has a respective pair of upper rollers 184*a* and a respective pair of lower rollers 184*b*. Each pair of upper rollers 184*a* is aligned for engaging a corresponding one of the upper carriage guide tracks 180*a* of the lift carriage 104. Each pair of lower rollers 184*b* is aligned for engaging a corresponding one of the lower carriage guide tracks 180*b* of the lift carriage 104.

A bracket 213 mounted to the rear tubular beam 212*b* connects the carriage cart 176 to the distal end 198 of the hydraulic cylinder 190.

The carriage cart 176 defines a passage therethrough (in the form of aligned holes 214*a* and 214*b* through the plates 210*a* and 210*b*) for receiving the pivot connector 179. In this example, optional bushings 216*a* and 216*b* are disposed in the holes 214*a* and 214*b*, respectively, and the pivot connector 179 is extends through the bushings 216*a* and 216*b*. The pivot connector extends outward past each of the plates 210*a* and 210*b* for attaching to the arm carts 178*a* and 178*b* on either side of the carriage cart 176.

Each carriage cart 178*a* and 178*b* comprises a respective body 218 and a pair of upper rollers 188*a* and a respective pair of lower rollers 184*b*. The upper rollers 188*a* of each carriage cart 178*a* and 178*b* are aligned for engaging an upper arm guide track 186*a* of the corresponding lift arm section 160*a* or 160*b*. The lower rollers 188*b* of each carriage cart 178*a* and 178*b* are aligned for engaging a lower arm guide track 186*b* of the corresponding lift arm section 160*a* or 160*b*.

Figure 11:
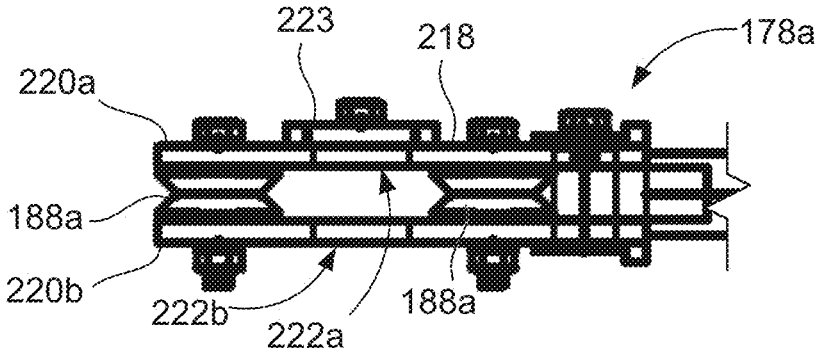
FIG. 11 is a top plan view of a carriage cart of the floating pivot mechanism of FIGS. 9 and 5 to 10.
Figure 12:
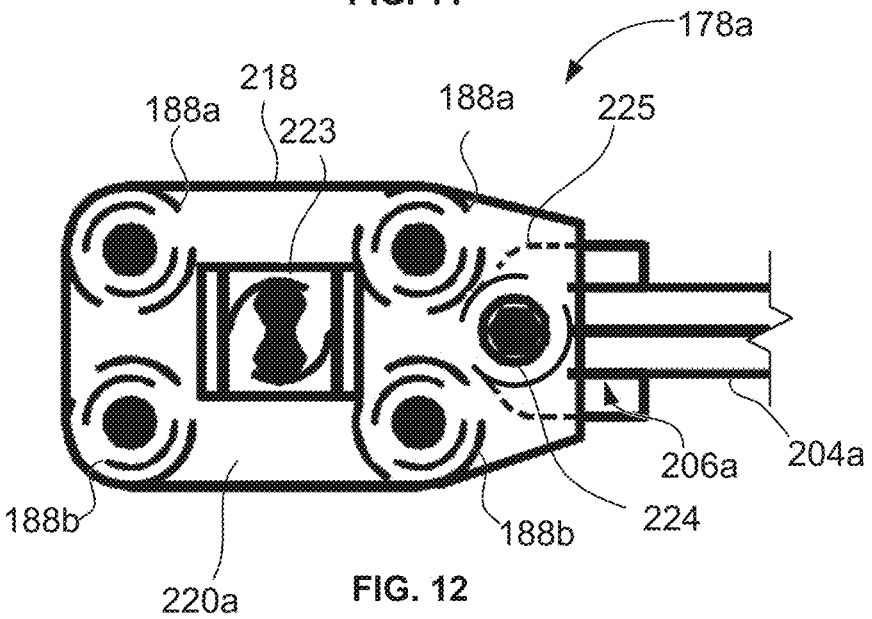
FIG. 12 is a side elevation view of the carriage cart of FIG. 11.
Figure 13:
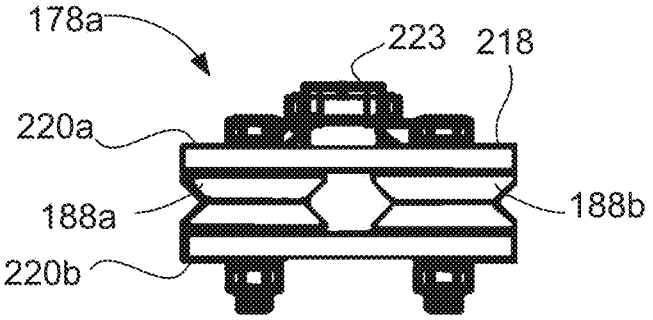
FIG. 13 is an end view of the carriage cart of FIGS. 11 and 12.

FIGS. 11, 12, and 13 are top plan, side elevation, and end views, respectively, of the first carriage cart 178*a* in FIGS. 9 and 10. The second carriage cart 178*b* mirrors the first carriage cart 178*a* in structure and function. The body of the carriage cart 178*a* comprises two spaced apart plates 220*a* and 220*b* with the rollers 188*a* and 188*b* mounted therebetween. The plates 220*a* and 220*b* have holes 222*a* and 222*b*, respectively, therethrough to receive the pivot connector 179. A cap 223 is mounted at the hole 222*b* of the outermost plate 220*b* to hold the cart 178*a* in place on the pivot connector 179. The cap 223 may prevent the pivot connector 179 from moving side to side or coming apart from the entire system.

As also shown in FIG. 12, the cart 178*a* is pivotably connected to the piston rod 204*a* by a pin 224 received in pivot mounting bracket 225 at the distal end 206*a* of the piston rod 204*a*.

Figure 19:
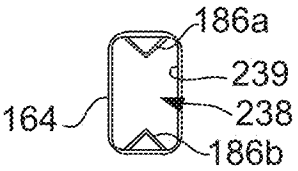
FIG. 19 is an end view of a main beam of the lift arm of FIGS. 18A and 18B.

The carriage carts 178*a* and 178*b* are each sized to be able to travel axially within the interior space of the main beams 164 of the corresponding lift arm section 160*a* or 160*b* (FIGS. 3 and 4). The interior space and guide tracks 188*a* and 188*b* of one of the beams are best shown in FIG. 19 described below.

The integration of the carriage axial adjustment mechanism 130 within the lift carriage 104, and the integration of the arm axial adjustment mechanism 132 within the lift arm 120 is shown in FIGS. 14 to 21.

Figure 14:
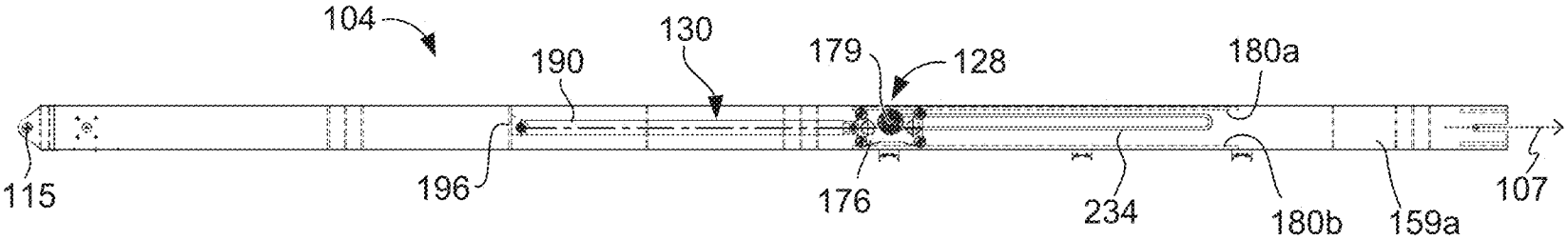
FIG. 14 is a side elevation view of the lift carriage and the floating pivot mechanism of FIG. 1.
Figure 15:
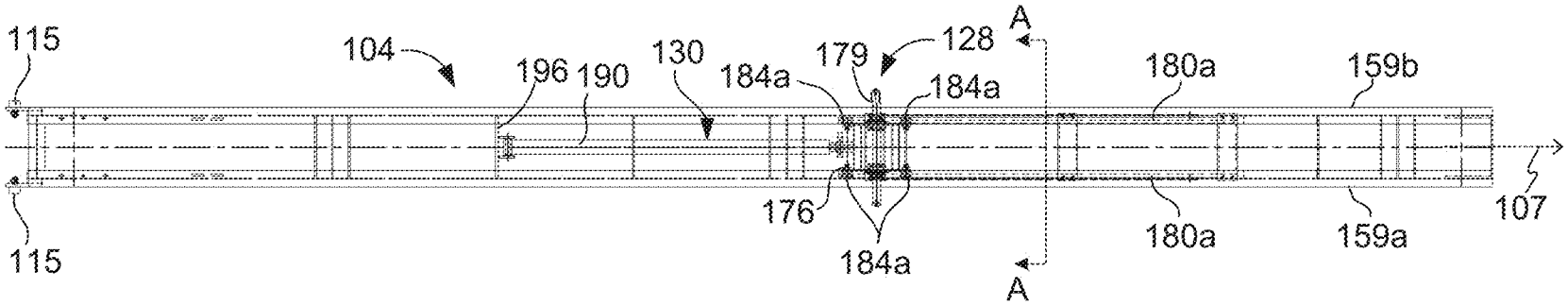
FIG. 15 is a top plan view of the lift carriage and the floating mechanism.
Figure 16:
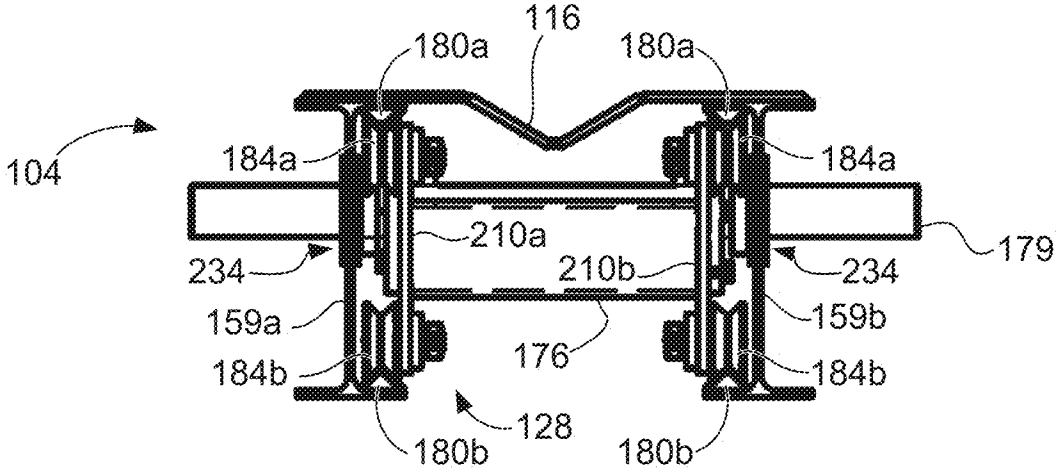
FIG. 16 is a cross sectional view of the lift carriage taken along the line A-A in FIG. 18.

FIG. 14 is a side elevation view of the lift carriage 104 of FIGS. 1 to 3 and the floating pivot mechanism 128. FIG. 15 is a top plan view of the lift carriage 104 and the floating mechanism 128 of FIG. 14 (but with the trough 116 removed so that other elements are visible). FIG. 16 is a cross sectional view of the lift carriage 104 taken along the line A-A in FIG. 15. In FIGS. 14 and 15, the carriage axial adjustment mechanism 130 (i.e. the hydraulic cylinder 190) is shown mounted between the side walls 159*a* and 159*b* and under the trough 116. The hydraulic cylinder 190 and carriage cart 176 are shown visible through the first side wall 159*a* in FIG. 14 for illustrative purposes. The arm carts 178*a* and 178*b* of the floating pivot mechanism 128 are removed in FIGS. 14 to 16.

In this example embodiment, the lift carriage 104 comprises a pair of upper carriage guide tracks 180*a* and a pair of lower guide tracks 180*b*. The upper and lower guide tracks 180*a* and 180*b* are substantially aligned with the longitudinal axis 107 of the lift carriage 104. The carriage cart 176 is slidably engaged with the carriage guide tracks 180*a* and 180*b*.

The carriage guide tracks 180*a* and 180*b* may be integrated with the lift carriage 104 in any suitable manner. In the present example embodiment, the first and second side walls 159*a* and 159*b* are each I-beams, as shown in FIG. 16, with a respective lower flange 230 and a respective upper flange 232. The pair of lower carriage guide tracks 180*b* are mounted over an inward portion of the lower flange 230, and the upper guide tracks 180*b* are mounted under an inward portion of the upper flange 232. The tracks 180*a* and 180*b* may be mounted using any suitable means (e.g. fasteners, adhesive, welding, etc.). Embodiments are not limited to the position or structure of the guide tracks 186*a* and 186*b* shown in this example. The guide tracks may also be omitted in other embodiments.

The upper rollers 184*a* of the carriage cart 176 engage the upper carriage guide tracks 180*a*, and the lower rollers 184*b* of the carriage cart 176 engage the lower carriage guide tracks 180*b*. More specifically, the upper and lower rollers 184*a* and 184*b* of the first plate 210*a* of the carriage cart 176 engage the upper and lower guide tracks 180*a* and 180*b* of the first side wall 159*a* of the lift carriage 104. The upper and lower rollers 184*a* and 184*b* of the second plate 210*b* of the carriage cart 176 engage the upper and lower guide tracks 180*a* and 180*b* of the second side wall 159*b*. The rollers 184*a* and 184*b* are wheels with a V-profile periphery, and the guide tracks 180*a* and 180*b* have inverse-V profile (mirroring the wheels). The rollers 184*a* and 184*b* are, thus, constrained to longitudinal movement along the guide tracks 180*a* and 180*b*. Embodiments are not limited to this particular configuration of the rollers and guide tracks. As also explained above, other means may be used to constrain the floating pivot mechanism to the desired collinear axial movement.

In this example embodiment, each of the side walls 159*a* and 159*b* of the lift carriage defines an elongated slot 234 therethrough. The pivot connector (pin) 179 extends through the slots 243 and the slot provides clearance for the pivot connector 179 throughout its range of axial movement Specifically, the slots 234 have a length that at least matches the actuation range of the hydraulic cylinder 190.

The rollers 184*a* and 184*b* in this embodiment are in the form of wheels. However, other rolling elements (e.g. bearings, cams) or sliding elements that may enable movement of the floating pivot mechanism relative to the lift carriage, and vice versa, may be used in other embodiments. For example, linear plain bearings (e.g. plastic or composite) may be used in other embodiments. Furthermore, embodiments are not limited to the roller/guide track structure shown in the drawings.

Embodiments are also not limited to lifts, cylinders or telescoping types of axial adjustment mechanisms. The carriage and/or arm adjustment mechanisms may also comprise one or more chain-driven or rack and pinion systems in some embodiments. Any suitable means for actuating axial movement of the floating pivot mechanism may be used. By way of example, in an alternate embodiment, the floating pivot mechanism may comprise one or more sprockets and the lift carriage may comprise a longitudinally aligned chain or track, with the sprocket(s) engaging the chain or track to move the lift carriage relative to the floating pivot mechanism.

The cam rollers 115 of the lift carriage 104 that engage the base 102 of the apparatus (FIG. 1) are also shown in FIGS. 14 and 15.

FIGS. 14 and 15 show the lift carriage 104 with the hydraulic cylinder 190 fully retracted (meaning that the lift carriage 104 is in a forward position relative to the floating pivot mechanism 128).

Figure 17:
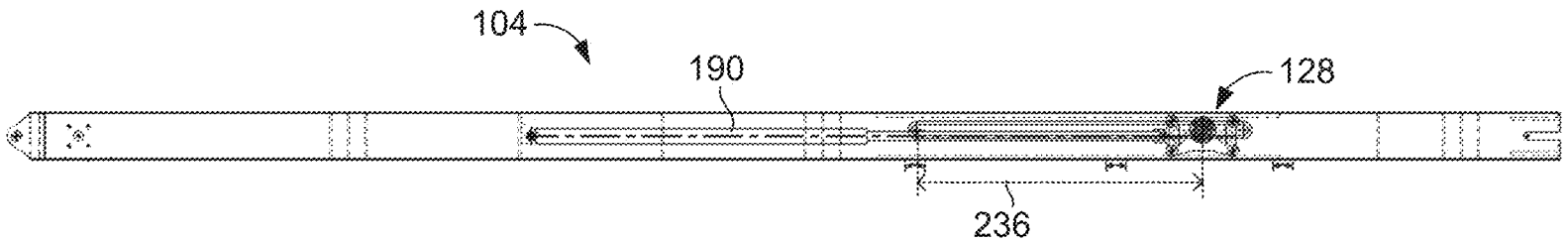
FIG. 17 is another side elevation view of the lift carriage of FIGS. 14 to 16.

FIG. 17 is a side elevation view of the lift carriage 104 showing the hydraulic cylinder 190 fully extended (meaning that the lift carriage 104 is in a rearward position relative to the floating pivot mechanism 128). The hydraulic cylinder 190 may be selectively positioned anywhere in the continuous range between the fully extended and fully retracted positions. The range of motion is indicated by arrow 236 in FIG. 17. Embodiments are not limited to this range of motion, and the range of motion may be larger of smaller in other embodiments. The floating pivot mechanism 128 may, for example, have an axial range of motion of in the range of 5 to 10 feet. The example apparatus 100 may, for example have a range of 7 feet of movement along the carriage arm axis.

Figure 18A:
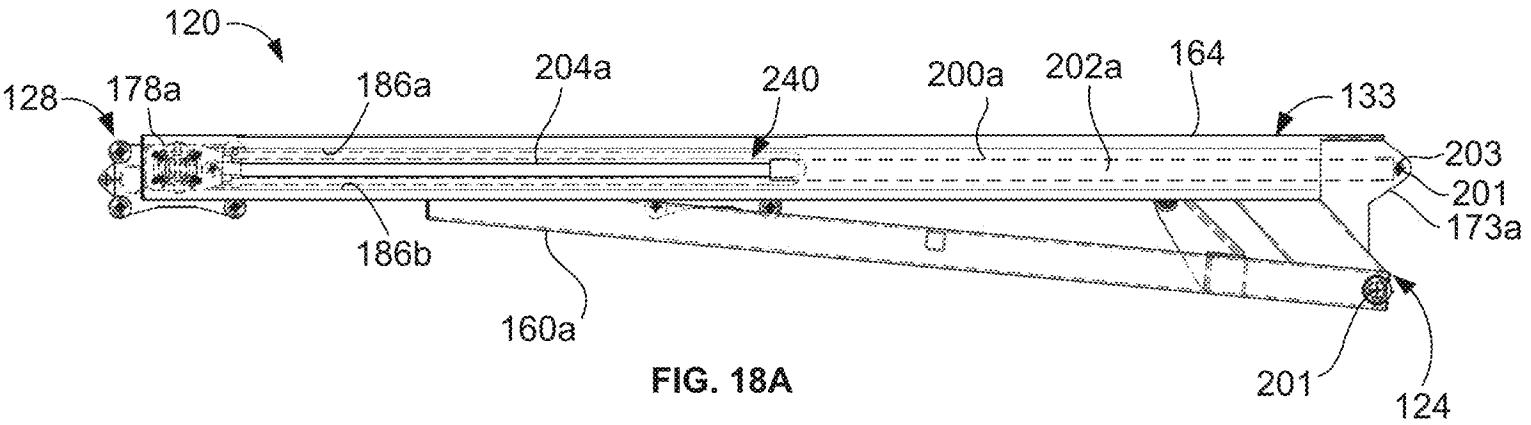
FIG. 18A is a side elevation view of the lift arm and floating pivot mechanism of FIG. 1.
Figure 18B:
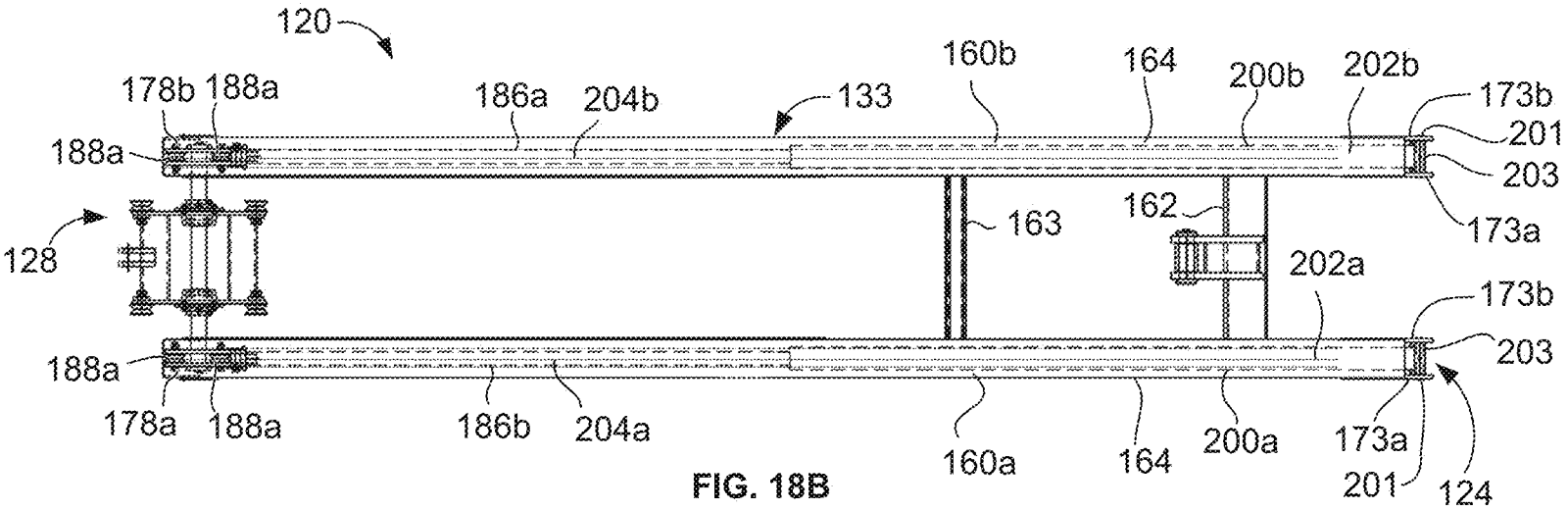
FIG. 18B is a top plan view of the lift arm and the floating mechanism.

FIG. 18A is a side elevation view of the lift arm 120 of FIGS. 1 to 3 and the floating pivot mechanism 128. FIG. 18B is a top plan view of the lift arm 120 and the floating mechanism 128.

In this example embodiment, the arm axial adjustment mechanism 130 (i.e. hydraulic cylinders 200*a* and 200*b*) is incorporated within the frame structure 133 of the lift arm 120. More specifically, one hydraulic cylinder is 200*a* is mounted within the main beam 164 of the first arm section 160*a*, and the other hydraulic cylinder 200*b* is mounted within the main beam 164 of the second arm section 160*b*. The hydraulic cylinders 200*a* and 200*b* are shown in FIGS. 18A and 18B for illustrative purposes, but would normally be substantially hidden from view.

Each main beam 164 has a respective upper guide track 186*a* and a respective lower guide track 186*b* therein. The terms "upper" and "lower" in this context refer to the relative position when the lift arm 120 is in the lowered position shown in FIGS. 2 to 4.

FIG. 19 is an end view of the main beam 164 of either arm section 180*a* or 160*b* showing the position of the respective upper guide track 186*a* and the lower guide track 186*b*. As shown, the main beam 164 is a hollow tubular with defining an interior space inner 238 and inner surface 239. The upper guide track 186*a* is attached to the upper face of the inner surface 239 and the lower track 186*b* is attached to the lower face of the inner surface 239. The guide tracks 186*a* and 186*b* may be attached in any suitable manner (e.g. fasteners, adhesive, welding, etc.). Alternatively, the guide tracks 186*a* and 186*b* may be formed integrally with the main beam (e.g. formed as an extrusion). Embodiments are not limited to the position or structure of the guide tracks 186*a* and 186*b* shown in this example. The guide tracks may also be omitted in other embodiments.

Turning again to FIGS. 18A and 18B, the arm carts 178*a* and 178*b* each slidably engage the guide tracks 186*a* and 186*b* of the corresponding arm section 160*a* or 160*b*. More specifically, the upper and lower rollers 188*a* (see FIGS. 11 to 13) of the first arm cart 178*a* engage the upper and lower guide tracks 186*a* and 186*b* of the first arm section 160*a*. The upper and lower rollers 188*a* (see FIGS. 11 to 13) of the second arm cart 178*b* engage the upper and lower guide tracks 186*a* and 186*b* of the second arm section 160*b*. Thus, each carriage cart 178*a* and 178*b* may move axially within the corresponding arm section 160*a* and 160*b*, as actuated by the corresponding hydraulic cylinder 200*a* and 200*b*. Typically, the hydraulic cylinders 200*a* and 200*b* of the lift arm 120 are connected to a hydraulic control to act in unison with each other.

The hydraulic cylinders 200*a* and 200*b* and the arm carts 178*a* and 178*b* are load bearing elements in this embodiment.

The rollers 188*a* and 188*b* of the arm carts 178*a* and 178*b* are wheels with a V-shaped periphery, and the guide tracks 186*a* and 186*b* have inverse-V profile, such that the rollers 184*a* and 184*b* are constrained to longitudinal movement along the guide tracks 186*a* and 186*b*. Embodiments are not limited to this particular profile of the rollers and guide tracks. Other rolling elements (e.g. bearings) may be used in other embodiments.

As shown, for each arm section 160*a* and 160*b*, the hydraulic cylinder 200*a* or 200*b* is mounted to the plates 173*a* and 173*b* at the end of the main beam 164. More specifically, in this example, a pin 201 extends through a bracket 203 at the end of the cylinder barrel 202*a* of the hydraulic cylinder 200*a* or 200*b*. The pin 201 also extends through the plates 173*a* and 173*b*. This attachment method using the plates 173*a* and 173*b* may be helpful in that it is not necessary to mount attachment hardware within the interiors of the main beams 164.

Embodiments are not limited to the particular guide track/roller structure described above. More or fewer guide tracks may be used in other embodiments, and guide tracks may be integrated with the lift carriage in another manner. In still other embodiments, other means may be used to allow sliding movement of a carriage engaging element and/or lift arm engaging element of the floating pivot mechanism. For example, a carriage engaging element may comprise a pin, and the lift carriage may comprise a slot, with the pin engaged with and constrained to movement within the slot. A similar slot/pin mechanism may be used to couple the floating pivot mechanism to the lift arm in other embodiments. Any suitable means to engage a pivot mechanism that allows longitudinal movement with respect to: (1) the lift arm; and (2) the lift carriage may be used in other embodiments.

Each main beam 164 of the first and second arm sections 160*a* and 160*b* defines a respective elongated slot 240 that provides clearance for the pivot connector (pin) 179. The pivot connector 179 extends through the slot 240 and into the interior of the main beams 164 to connect to the arm carts 178*a* and 178*b*. The slots 240 of the first and second arm sections 160*a* and 160*b* are, thus, each in a respective side 242*a* or 242*b* of the main beam 164 facing the lift carriage 104. The slot 240 shown in FIG. 18B in stippled lines as it would not be visible from the perspective shown in FIG. 18B.

FIGS. 18A and 18B show the lift arm 110 with the piston rods 204*a* of the hydraulic cylinders 200*a* and 200*b* fully extended. This fully extended position means that the distance between the first arm end 124 (which is pivotably coupled to the base 102) and the floating pivot mechanism 128 at its maximum for this embodiment.

Figure 20:
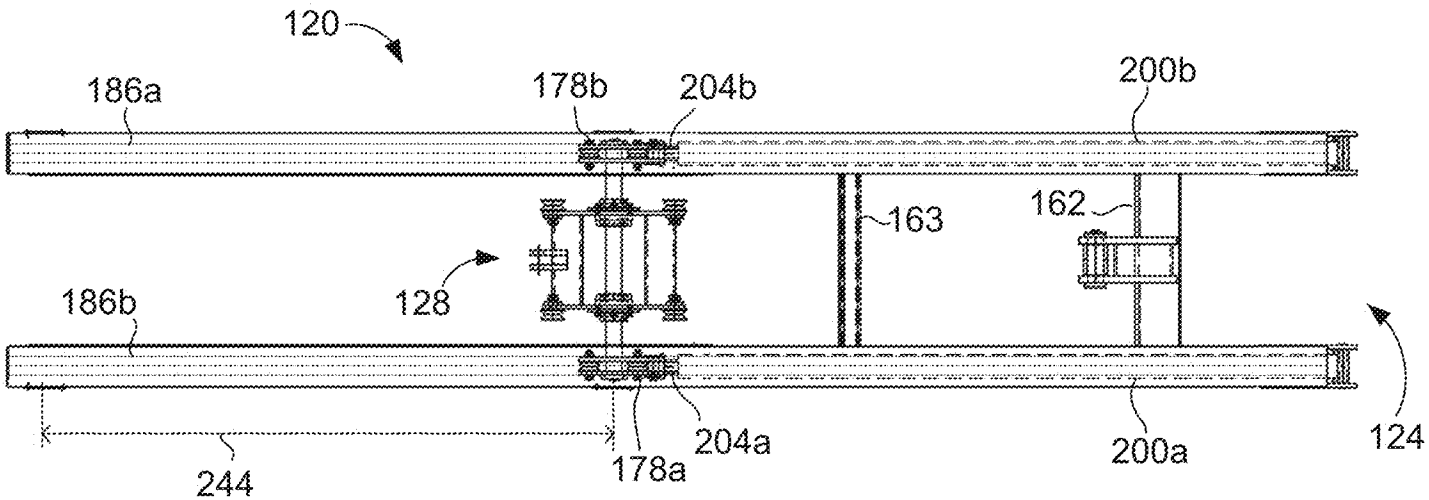
FIG. 20 is another side elevation view of the lift arm of FIGS. 18A to 19.

FIG. 20 is a top plan view of the lift arm 120 showing the piston rods 204*a* of the hydraulic cylinders 200*a* and 200*b* fully retracted. This fully retracted position means that the distance between the first arm end 124 (which is pivotably coupled to the base 102) and the floating pivot mechanism 128 at its minimum for this embodiment. The hydraulic cylinders 200*a* and 200*b* may be positioned anywhere in the continuous range between the fully extended and fully retracted positions, thereby providing an effective range of motion indicated by arrow 244 in FIG. 20. The floating pivot mechanism 128 may, for example, have an axial range of motion of in the range of 5 to 10 feet. The example apparatus 100 may, for example have a range of 7 feet of movement along the lift arm axis. Embodiments are not limited to this range of motion, and the range of motion may be larger of smaller in other embodiments.

FIGS. 21A to 21D illustrate a modified embodiment of the lift arm 120 of FIGS. 18A, 18B and 20. The lift arm 120 in this embodiment is modified to include additional supporting plate structures 245 and 246 to provide structural support for the lift arm 120. Lateral plate structure 245 extends between the first and second arm sections 160*a* and 160*b* in the region of the first cross beam 162. The lateral plate structure 245 is also connected to and helps support the bracket 174 that attaches to the hydraulic cylinder 141 (see FIG. 1). For each arm section 180*a* and 160*b*, a vertical supporting plate structure 246 extends between each main beam 164 and angled beam 166.

Figure 21A:
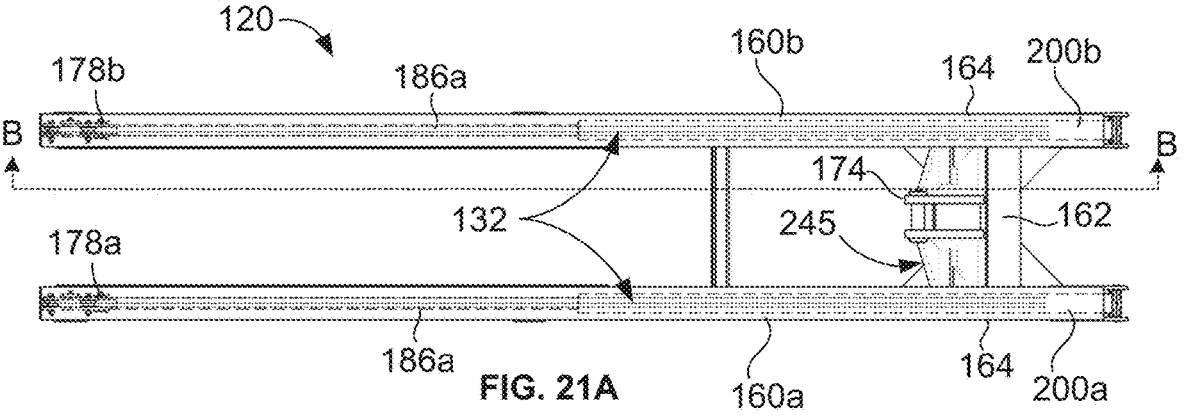
FIG. 21A is a top plan view of a modified lift arm according to some embodiments.
Figure 21B:
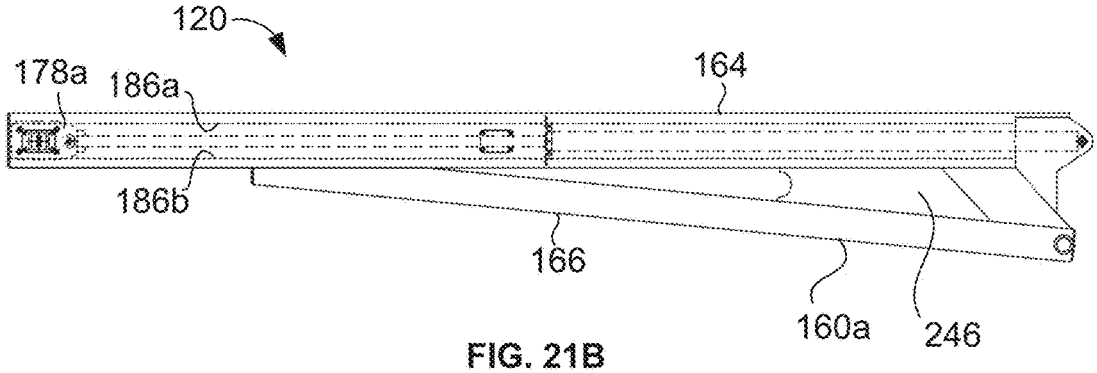
FIG. 21B is a side elevation view of the lift arm of FIG. 21A.

FIGS. 21A and 21B are top plan and side elevation views respectively of the lift arm 120. The hydraulic cylinders 200*a* and 200*b* of the arm axial adjustment mechanism 132 are shown in stippled lines, as are the arm carts 178*a* and 178*b* and guide tracks 186*a* and 186*b*. The stippled lines indicate that those components would normally be hidden by the main beams 164.

Figure 21C:
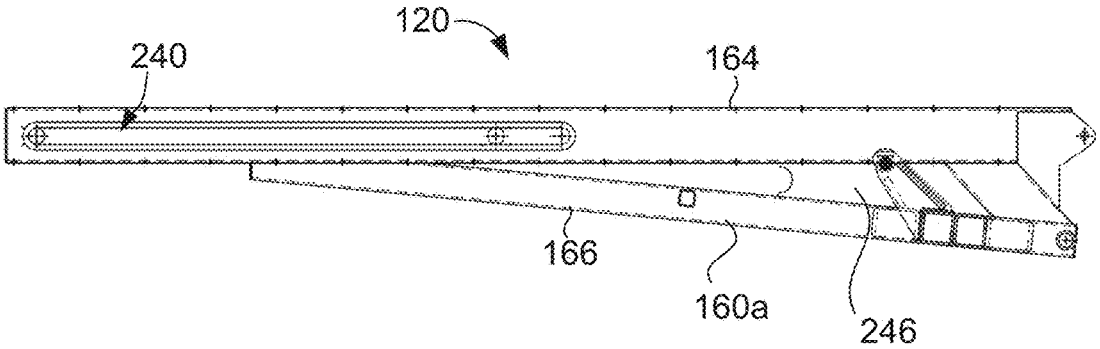
FIG. 21C is a side cross sectional view of the lift arm taken along the line B-B in FIG. 21A.

FIG. 21C is a side cross sectional view taken along the line B-B in FIG. 21A. FIG. 21C shows the slot 240 in the main beam 164 that provides clearance for the pivot connector 179 of the floating pivot mechanism 128 (see FIGS. 6 to 10). The arm cart 178*b* and hydraulic cylinder 200*b* are not shown in FIG. 21C.

Figure 21D:
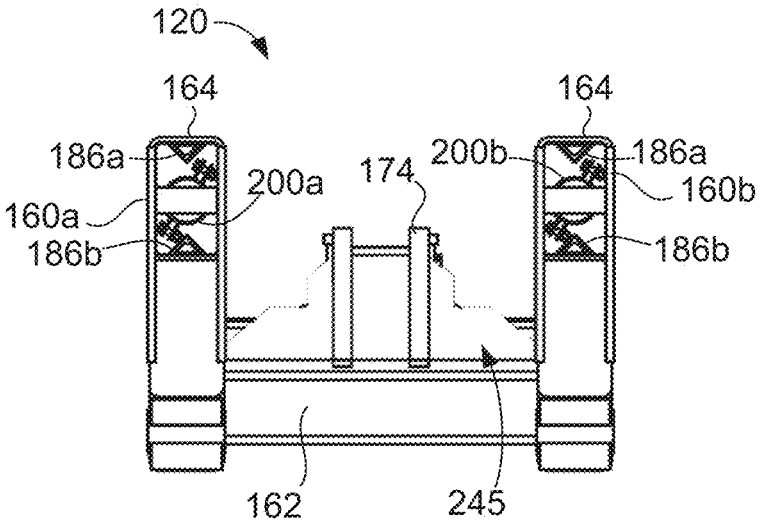
FIG. 21D is an end view of the lift arm of FIGS. 21A to 21C.

FIG. 21D is an end view of the lift arm 120 of FIGS. 21A to 21C. The upper and lower guide tracks 186*a* and 186*b* and the hydraulic cylinders 200*a* and 200*b* are visible in this view, as positioned in the main beams 164 of the lift arm 120.

Operation of the example pipe handling apparatus 100 will now be described with reference to FIGS. 1 and 22 to 28.

Example configurations and movement of the apparatus 100 are shown in FIGS. 1 and 22 to 24. The carriage axial adjustment mechanism 130, the arm axial adjustment mechanism 132 and the arm rotation mechanism 140 may be independently controlled to move the lift carriage 104. For example, the apparatus may include a power unit and/or one or more motors, a hydraulic fluid reservoir, filters, a valve bank, etc. or other components operable to independently control the adjustment mechanisms 130, 132 and 140. Such power and/or control components may be manually controlled and/or controlled by a computer means, such as a general purpose computer or a programmable logic controller (PLC).

Figure 22:
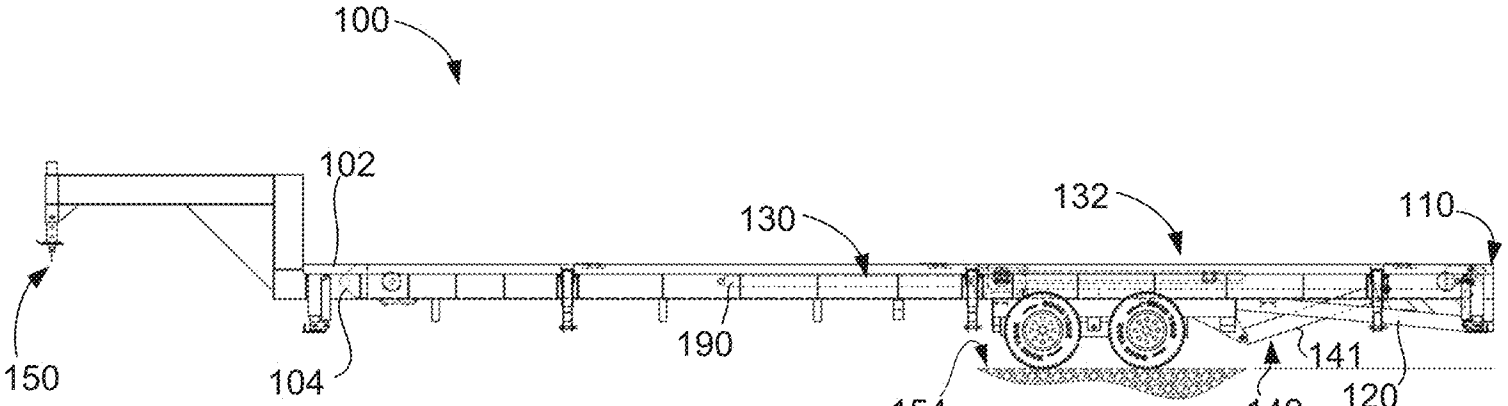
FIG. 22 is a side elevation view of the apparatus of FIGS. 1 and 2 in the fully lowered position.

FIG. 22 is a side elevation view of the apparatus 100 in the fully lowered position. Thus, the lift carriage 104 and lift arm 120 are lowered and substantially aligned with the base 102. The lift carriage 104 and lift arm 120 are received in the cavity 186 (FIG. 2) of the base. In this configuration, the arm rotation mechanism 140 (hydraulic cylinder 141) is fully retracted, with the lift arm 120 extending substantially rearward, toward the rear base end 150. When the lift arm 120 is fully lowered, the carriage adjustment mechanism 130 (hydraulic cylinder 190) and arm axial adjustment mechanism 132 (hydraulic cylinders 200*a* and 200*b*) may be in the configuration shown in FIGS. 7 and 8, or in another intermediate configuration. In FIG. 22, the adjustment mechanisms 130 and 132 are in the position shown in FIGS. 7 and 8. Namely, the carriage adjustment mechanism 130 is fully retracted, and the arm axial adjustment mechanism 132 is fully extended.

In this lowered position, the forward carriage end 110 may, for example, be approximately 3 to 4 feet above the bearing surface 154, although embodiments are not limited to this range.

From this lowered position, the lift arm 120 may be rotated upward and away from the rear base end 150 (i.e. clockwise in FIG. 22) to raise the forward carriage end 110.

Figure 23:
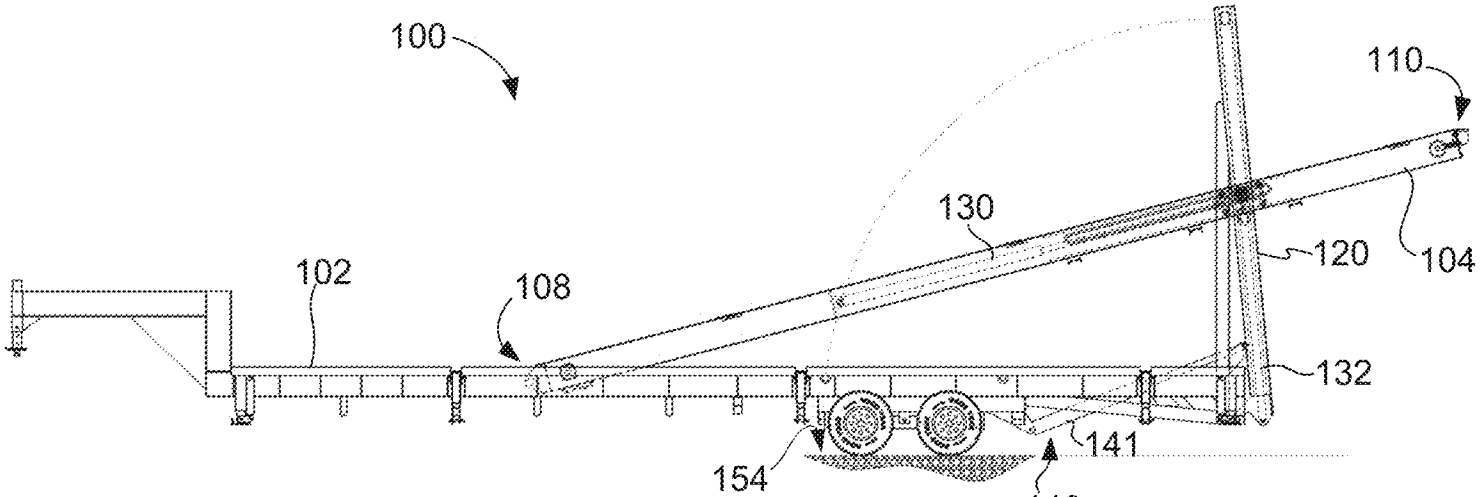
FIG. 23 is a side elevation view of the apparatus of FIGS. 1, 2 and 22 in an example raised position.

FIG. 23 is another side elevation view of the apparatus 100 in a partially raised position, which is only one of a large range of possible positions. In FIG. 23, the lift arm 120 has been rotated to its fully upright position by extension of the arm rotation mechanism 140 (i.e. hydraulic cylinder 141). However, the available range of rotation may be greater or less in other embodiments.

In this configuration, the carriage adjustment mechanism 130 is fully extended, meaning that the lift carriage 104 is in a rear-most position relative to the floating pivot mechanism 128. The arm axial adjustment mechanism 132 is fully retracted, meaning that the "effective length" of the lift arm is at its minimum for this embodiment.

In this lowered position, the forward carriage end 110 may, for example, be approximately 12 to 13 feet above the bearing surface 154, although embodiments are not limited to this range.

Turning again to FIG. 1, the pipe handling apparatus 100 has the same the arm rotational position and lift carriage axial position as in FIG. 23. However, in FIG. 1, the arm axial adjustment mechanism 132 has been partially extended, thereby increasing the "effective length" of the lift arm 120 and further raising the forward carriage end 110. This, in turn, increases the angle of the lift carriage 104 relative to the base 102. The carriage adjustment mechanism 130 is also partially retracted, meaning that the lift carriage 104 is has moved forward, axially, relative to the floating pivot mechanism 128.

Figure 24:
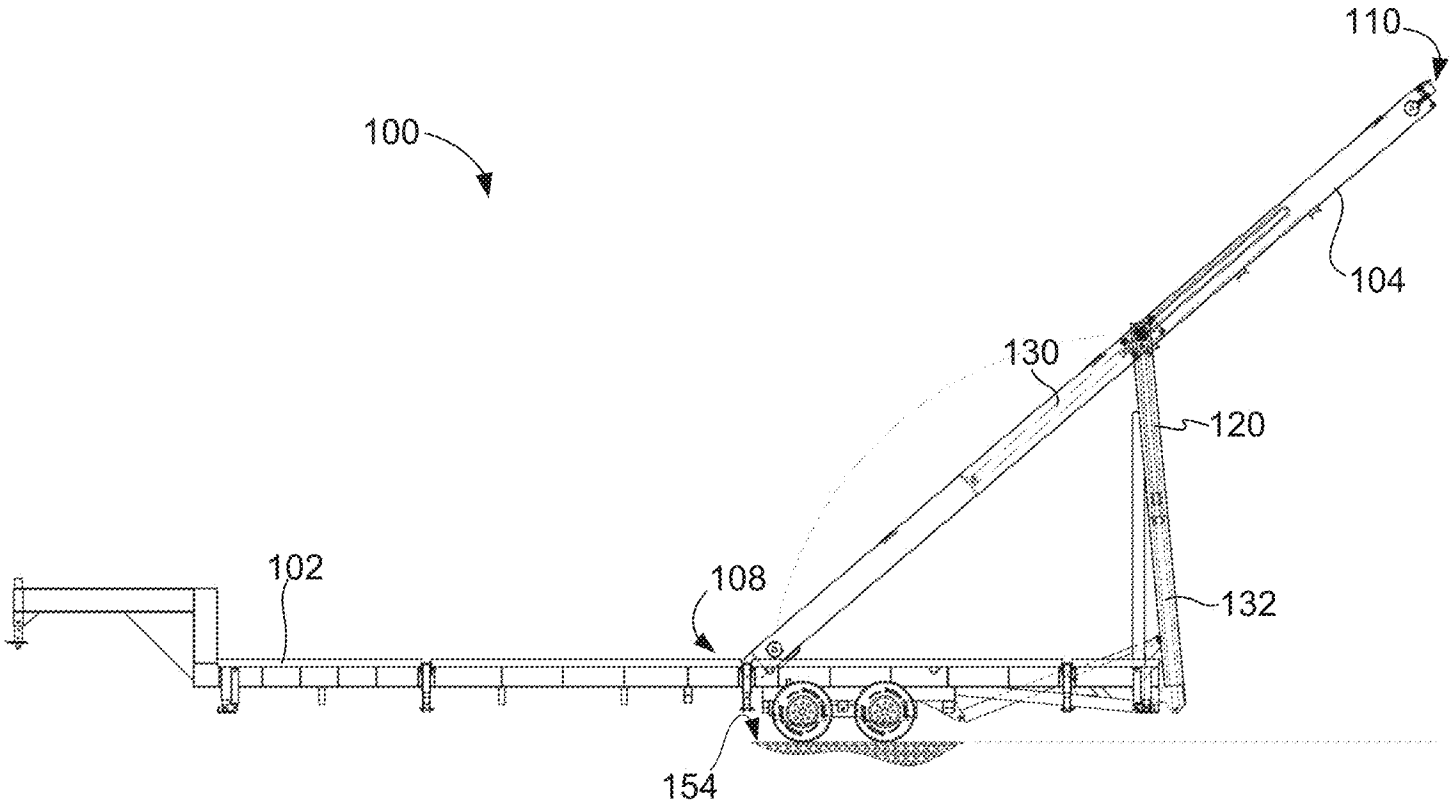
FIG. 24 is a side elevation view of the apparatus of FIGS. 1, 2 and 22 in a fully raised position.

FIG. 24 is another side elevation view of the apparatus 100 in a fully raised and extended position. Similar to FIG. 1, the lift arm 120 has been rotated to its fully upright position. However, the arm axial adjustment mechanism 132 has now been fully extended. Furthermore, the carriage adjustment mechanism 130 is fully retracted, meaning that the lift carriage 104 is in a forward-most position relative to the floating pivot mechanism 128. As shown, moving the lift carriage axially forward also raises the forward carriage end 110, and increases the angle of the lift carriage 104 relative to the base 102. In this example embodiment, the forward carriage end 110 may be in the range of approximately 25 to 30 feet above the bearing surface 154, when the apparatus 100 is in the fully extended configuration shown. However, this fully extended height will depend on various factors including the length of the lift carriage and lift arm, the height of the base, and the range of motion of the floating pivot mechanism, all of which may vary in different implementations.

The carriage axial adjustment mechanism 130 be set at any position in between the rearward and forward positions shown in FIGS. 23 and 24. The arm axial adjustment mechanism 132 may also be set at any position in between the extended and retracted positions shown in FIGS. 23 and 24.

Embodiments are not limited to the range of motion of the arm axial adjustment mechanism 132 shown in FIGS. 23 and 24. The available range of rotation may be greater or less in other embodiments. In other words, the possible "effective length" range of the lift arm 120 may vary, and is not limited to the range shown in the drawings. Embodiments are also not limited to the range of motion of the carriage axial adjustment mechanism 130 shown in FIGS. 23 and 24. The available range of rotation may be greater or less.

In some embodiments, the pipe handling apparatus may include a computer system that controls movement of one or more of the carriage axial adjustment mechanism 130, the arm axial adjustment mechanism 132 and the arm rotation mechanism 140. For example, a user may input a desired position (e.g. height) of the forward end 110 of the lift carriage, and the computer system may automatically calculate a configuration for each of the arm axial adjustment mechanism 132 and the arm rotation mechanism 140. The computer system may further output control signals to control the adjustment mechanisms 130, 132 and 140 to move to the calculated configuration.

FIG. 25 is a block diagram of an example control system 300 for a tubular handling apparatus, such as the apparatus 100 described above with reference to FIGS. 1 to 24. However, it is to be understood that embodiments are not limited to the particular control system 300 shown in FIG. 25.

The example control system 300 includes a computer system 301 and a hydraulic control module 302. The computer system may be part of the pipe handling apparatus, or may be a remote computing unit (e.g. laptop, desktop computer, tablet, mobile communications device, etc). The computer system may comprise programmable logic controller (PLC). Embodiments are not limited to any particular computer hardware and/or software. In this example, the computer system 301 includes a processor 304, a memory 306 operatively coupled to the processor 304, and at least one user interface 308.

In this example, the adjustment mechanisms 130, 132 and 140 comprise hydraulic cylinders as described above. The hydraulic control unit 302 may include a hydraulic power source (such as a hydraulic fluid reservoir and one or more hydraulic motors) and control components such as a valve bank, etc. or other components operable to independently provide hydraulic power and selectively activate the adjustment mechanisms 130, 132 and 140. The components of the hydraulic control module 302 may be housed together (as part of a single unit). Alternatively, components may be distributed in separate locations. One or more components of the hydraulic control module 302 may be stored in or on the base 102 (FIG. 1).

The example computer system 301 is operatively connected to the hydraulic control module 302 via connection 312 for sending control signals from the computer system 301 to the hydraulic control module 302. The connection 312 may comprise a wired and/or wireless connection. The connection 312 may be direct or may be implemented using one or more communication networks (e.g. Internet, wireless communication network, Bluetooth, Internet of Things (IoT), etc.).

As also explained above, embodiments are not limited to hydraulically driven adjustment mechanisms, and other embodiments may include other types of actuators (e.g. electric-motor-driven, pneumatic, etc.). In some embodiments, the hydraulic control module 302 is omitted and the computer 301 interfaces directly with the adjustment mechanisms 130, 132 and 140.

The user interface 308 may include one or more input devices and may further include one or more output devices. Without limitation, the user interface 308 may include touchscreen controls, one or more physical keys, one or more displays, etc.

The memory 306 has stored thereon processor executable instructions to be executed by the processor 306 in order to implement the functionality described herein. The processor generates control signals to output to the hydraulic control module 302, which, in turn, controls one or more of: the carriage axial adjustment mechanism 130; the arm axial adjustment mechanism 132; and the arm rotation mechanism 140 responsive to the signals from the computer system 301.

The hydraulic control module 302 is operably connected to the adjustment mechanisms 130, 132 and 140 by hydraulic line connections 314, 316 and 318 respectively.

The hydraulic control module 302 may optionally include one or more manual controls for directly controlling one or more of the adjustment mechanisms 130, 132 and 140.

Sensors 310*a* to 310*c* may optionally be provided that provide feedback to the processor 304 indicating the current configuration or position of each of the adjustment mechanisms 130, 132 and 140. Sensors 310*a* to 310*c* may be provided separately, as part of the system 300 and/or as part of the forward lifting assembly 106 and lift carriage 104 as shown.

A first sensor 310*a* may be operably connected to the lift carriage 104 to provide sensor output indicating the current configuration/position of the carriage axial adjustment mechanism 130. In some embodiments, the sensor 310*a* may be coupled to and/or internal to the carriage axial adjustment mechanism 130 (e.g. hydraulic cylinder 190).

A second sensor 310*b* may be positioned in or on the forward lifting assembly 106 to provide sensor output indicating the current configuration/position of the arm axial adjustment mechanism 132. In some embodiments, the sensor 310*b* may be coupled to and/or internal to the arm axial adjustment mechanism 132 (e.g. hydraulic cylinders 200*a* and/or 200*b*).

A third sensor 310*c* may similarly be arranged in or on the forward lifting assembly 106 to provide sensor output indicating the current configuration/position of the arm rotation mechanism 140.

In other embodiments, one or more of the adjustment mechanisms 130, 132 and 140 may have a different feedback mechanism that provides generates an output indicating the current position/configuration of the one or more of the adjustment mechanisms 130, 132 and 140, and that output may be sent to the computer 301.

In this example, feedback from the sensors 310*a* to 310*c* is provided to the processor 304 over connections 320, 322 and 324 respectively. These connections 320, 322 and 324 may comprise a wired and/or wireless connection. The connections 320, 322 and 324 may be direct or may be implemented using one or more communication networks (e.g. Internet, wireless communication network, Bluetooth, Internet of Things (IoT), Controller Area Network bus (CANbus) or PROFIBUS (Process Field Bus) systems, etc.). The output from the sensors 310*a* to 310*c* may be used by the processor to determine and/or monitor the current position/configuration of each of the adjustment mechanisms 130, 132 and 140. The processor 304 may thereby determine and/or monitor the configuration of the pipe handling apparatus (in including the current position of the lift carriage).

In some embodiments, a selected configuration of the lift carriage 104 may be input into the user interface 308 or otherwise received by the computer 301. The selected configuration may be a specific height and/or lateral position of the forward end 110 of the lift carriage 104. The selected configuration may also be selected from one or more predetermined configuration options presented to a user (e.g. fully lowered, fully extended, or a variety of other configurations). The processor 304 may then automatically perform one or more actions comprising: (1) calculate a position/configuration of each of the adjustment mechanisms 130, 132 and 140 that will place the lift carriage 104 in the selected position; (2) output control signals to drive the adjustment mechanisms 130, 132 and 140 to move the lift carriage 104 to the selected position; and (3) monitor sensor output to determine whether the adjustment mechanisms 130, 132 and 140 are in the proper configuration.

In the example of FIG. 25, the control signals may be sent from the processor 304 to the hydraulic control module 302 to actuate one or more of the adjustment mechanisms 130, 132 and 140. However, in other embodiments, the adjustment mechanisms may be electronically controllable and the processor may send control signals directly to one or more of the adjustment mechanisms. Alternatively, one or more other components (e.g. pneumatic control module) may be intermediate the processor and the adjustment mechanisms, depending on the type and configuration of the adjustment mechanisms.

The apparatus 100 may be controlled such that, for some movements or ranges of movement, the adjustment of one or more of the arm rotation, arm axial movement and carriage axial movement are co-dependent. For example, the processor 304 in FIG. 25 may control the hydraulic control module 302 such that, when initially moving the lift carriage up from the fully lowered position (shown in FIGS. 2 and 22), the arm rotation adjustment mechanism 140, the arm axial adjustment mechanism 132 and the carriage axial movement 132 all move together until the lift carriage has reached a threshold position. At that point, the arm rotation adjustment mechanism 140, the arm axial adjustment mechanism 132 and the carriage axial movement 132 may then be independently actuated for further movement. The reverse may also be implemented such that lowering the lift carriage from a threshold position to the fully lowered position is accomplished by co-dependent, simultaneous actuation of the arm rotation adjustment mechanism 140, the arm axial adjustment mechanism 132 and the carriage axial movement 132. This collectively dependent movement of the three adjustment mechanisms may be used to ensure that the lift carriage maintains clearance of the base when being lowered into or raised out of the cavity in the base, for example.

Figure 26:
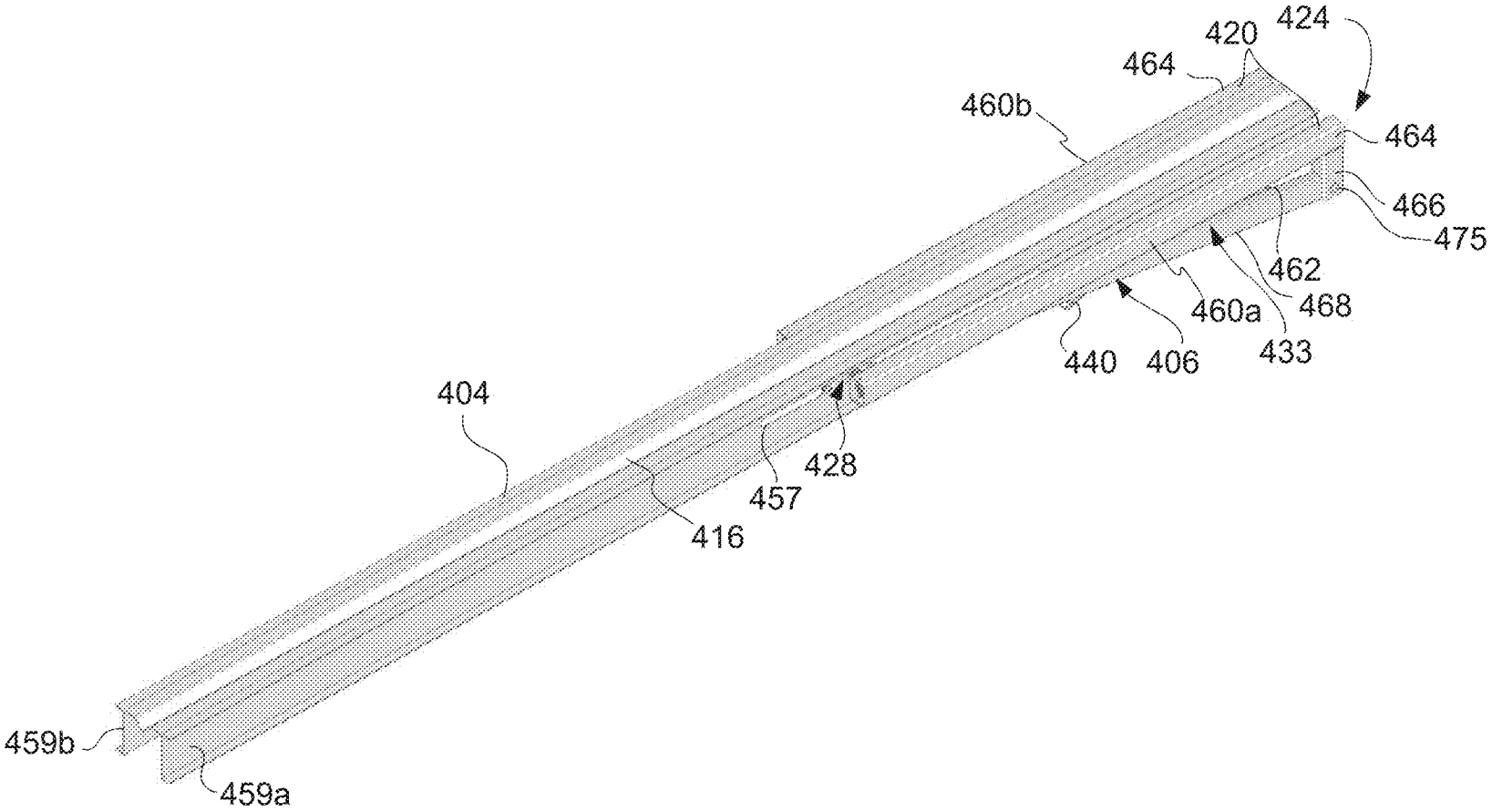
FIG. 26 is a perspective view of a lift carriage, a forward lifting assembly and a floating pivot mechanism according to another embodiment.

FIG. 26 is a perspective view of a lift carriage 404, a forward lifting assembly 406 and a floating pivot mechanism 428 according to another embodiment. The lift carriage 404 and the forward lifting assembly 406 may be mounted to a base (such as base 102 in FIG. 1) to form a pipe handling apparatus. The lift carriage 404, the forward lifting assembly 406, and the floating pivot mechanism 428 function similarly to the lift carriage 104 and forward lifting assembly 106 discussed above with reference to FIGS. 1 to 25. That is, the position of the floating pivot mechanism 428 is adjustable for collinear movement along the longitudinal axis of the lift carriage 404 and along the longitudinal axis of the lift arm 420 of the forward lifting assembly 406.

The lift carriage 404 comprises a trough 416 and first and second lift carriage side walls 459*a* and 459*b*, which are spaced apart and mirror each other. The trough 416 is in the form of a weldment in this example. The trough 416 has a generally V-shaped profile and extends for substantially the entire length of the lift carriage 404. The trough 416 is configured to accommodate the sizes and lengths of pipe joints which are to be handled by the pipe handling apparatus 400. The trough 416 is mounted on, and is supported by the first and second lift carriage side walls 459*a* and 459*b*.

The lift carriage 404 comprises an axial adjustment mechanism 430 (best shown in FIGS. 27 and 28) for actuating movement of the lift carriage 404 relative to the floating pivot mechanism 428. The side walls 459*a* and 459*b* of the lift carriage 404 each define a respective longitudinal slot 457 therethrough that provides clearance for the movement of the floating pivot mechanism 428 within the actuation range of the carriage axial adjustment mechanism 430.

The forward lifting assembly 406 comprises a lift arm 420 that may be pivotably coupled to the base (not shown). The lift arm 420 comprises a lift arm frame structure 433, which is a rigid weldment in this embodiment, and a lift arm axial adjustment mechanism 432 (best shown in FIGS. 27 and 28). The lift arm 420 again comprises first and second arm sections 460*a* and 460*b*, which are spaced apart and mirror each other. The first and second arm sections 460*a* and 460*b* are connected by a cross beam 462 (best shown in FIGS. 27 and 28).

Each arm section 460*a* and 460*b* includes a respective main beam 464 and a shorter transverse beam 466 connected to make an L-shape. Each arm section 460*a* and 460*b* further includes a respective angled support beam 468*a* connected to the main beam 464 (part way between the main beam's ends) and the transverse beam 466 similar to a triangular truss configuration, with the angled support beam 468*a* angled support beam 468 acting as a strut or brace to provide support.

Each of the transverse arm beams 466*a* and 486*b* comprises a respective pivot hole 475 near a first lift arm end 424 for receiving a pin (not shown) to pivotably connect the arm 420 to the base.

Figure 27:
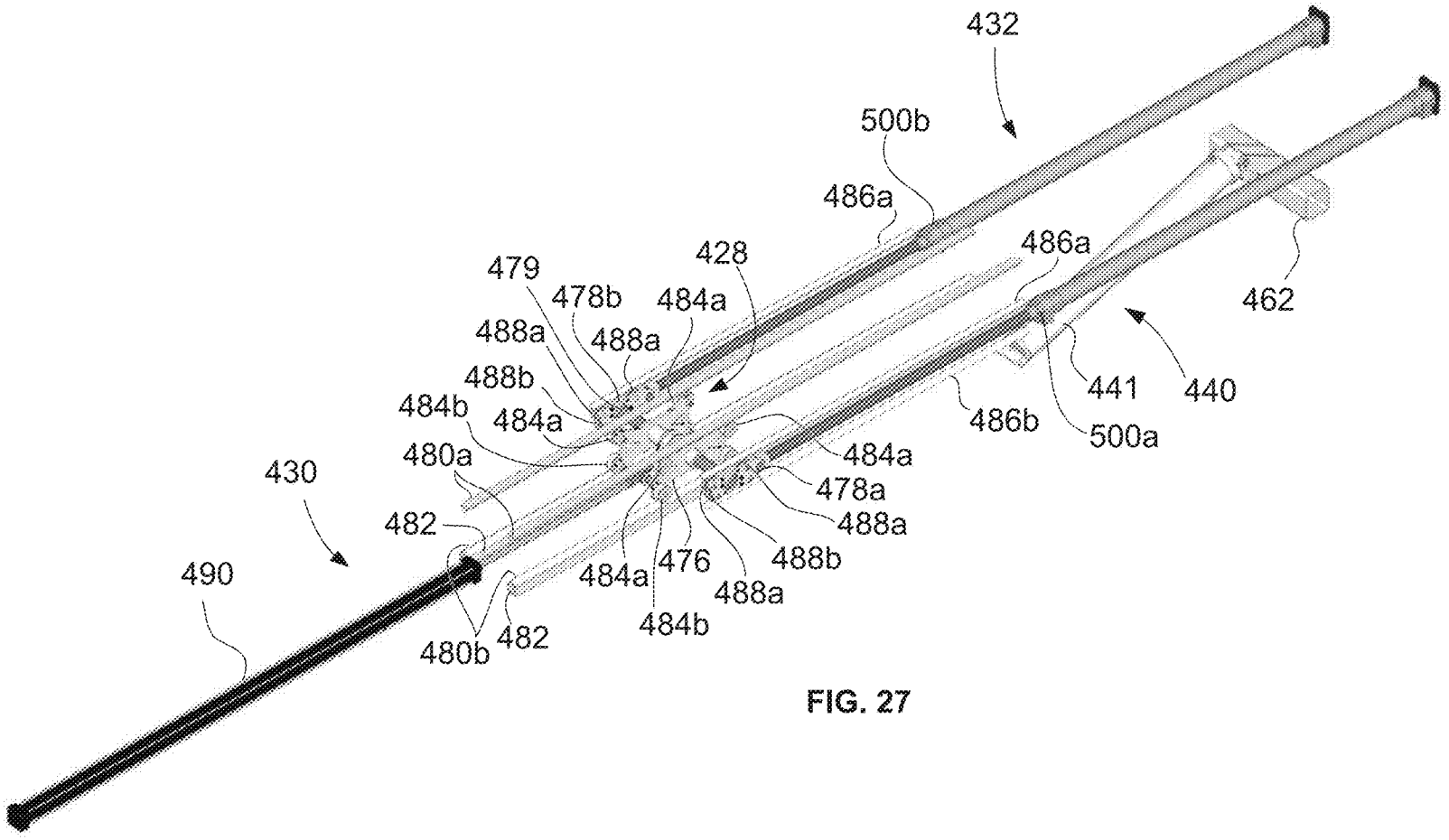
FIG. 27 is a perspective view of a carriage axial adjustment mechanism, an arm axial adjustment mechanism and the floating pivot mechanism of this embodiment according to the embodiment of FIG. 26.

FIG. 27 is a perspective view of the carriage axial adjustment mechanism 430, the arm axial adjustment mechanism 432 and the floating pivot mechanism 428 of this embodiment. Guide track components (480*a*, 480*b*, 484*a*, 484*b*) of the lift carriage 404 and lift arm 420 of FIG. 268, which are slidably engaged by the floating pivot mechanism 428, are also shown.

In this embodiment, the floating pivot mechanism 428 comprises: a carriage cart 476 that engages the lift carriage 404; two arm carts 478 that engage the lift arm 420; and a pivot connector 479 coupling the carriage cart 476 and the arm carts 478.

The pivot connector 479 in this example is a pivot pin that is received through each of the carriage cart 476 and the arm carts 478 to allow the carriage cart 476 to pivot with respect to the arm carts 478 and vice versa. However, it will be appreciate that alternate structures may couple cart and lift carriage engaging elements together in other embodiments.

Similar to the first embodiment shown in FIGS. 1 to 25, the carriage cart 476 is slidably engaged with the lift carriage 404 and fixedly coupled to the carriage axial adjustment mechanism 430. The lift carriage 404 comprises upper and lower carriage guide tracks 480*a* and 480*b* that are substantially aligned with the longitudinal axis 407 of the lift carriage 404, and the carriage cart 476 is slidably engaged with the carriage guide tracks 480*a* and 480*b*. The carriage guide tracks 480*a* and 480*b* are spaced apart and affixed (by any suitable method) to the underside of the trough 416, while two spaced apart lower tracks 480*b* are affixed to respective beams 482. The beams 482 are affixed (by any suitable method) to respective inward facing side surfaces of the carriage side walls 469*a* and 459*b*. The carriage cart 476 comprises upper rollers 484*a* engaged to the upper carriage guide tracks 480*a*, and lower rollers 484*b* engaged to the lower carriage guide tracks 480*b*. The rollers 484*a* and 484*b* are wheels in this embodiment. Other rolling elements (e.g. bearings) may be used in other embodiments.

Also similar to the first embodiment shown in FIGS. 1 to 28, the arm carts 478 are each slidably engaged with the lift arm 420 and fixedly coupled to the arm axial adjustment mechanism 432. The lift arm 420 again comprises upper and lower arm guide tracks 486*a* and 486*b* in each of the first and second arm sections 460*a* and 460*b* (FIG. 26). More specifically, the main beams 464 (FIG. 26) of the arm sections 460*a* and 460*b* are hollow with inner surfaces, and each main beam 464*a* and 464*b* has a corresponding set of one upper guide track 486*a* and one lower guide track 486*b* mounted to opposing faces of its inner surface.

Each arm cart 478 is slidably engaged with a corresponding pair of the carriage guide tracks 486*a* and 486*b* within a respective main beam 464 and 464. Each arm cart 478 comprises respective upper and lower rollers 488*a* and 488*b* engaged to the corresponding upper and lower arm guide tracks 486*a* and 486*b*.

The carriage axial adjustment mechanism 430 actuates forward and reverse movement of the lift carriage 404 with respect to the floating pivot mechanism 428, and the arm axial adjustment mechanism 432 actuates movement of the floating pivot mechanism 428 with respect to the first end 424 of the lift arm 420 (changing the effective length of the lift arm 420).

The carriage axial adjustment mechanism 430 in this embodiment comprises a hydraulic cylinder 490 connected between the rigid structure of the lift carriage 404 and the floating pivot mechanism 428.

The arm axial adjustment mechanism 432 comprises two hydraulic cylinders 800*a* and 500*b*, each connected between the arm frame structure 433 (FIG. 26) of the lift arm 420 and the floating pivot mechanism 428.

The hydraulic cylinder 441 that functions as the arm rotation mechanism 440 is also shown in FIG. 27.

The hydraulic cylinders 441, 490, 500*a* and 500*b* in this embodiment are arranged and function similarly to the hydraulic cylinders 141, 190 and 200*a* and 200*b* of the apparatus 100 described with reference to FIGS. 1 to 24.

Figure 28:
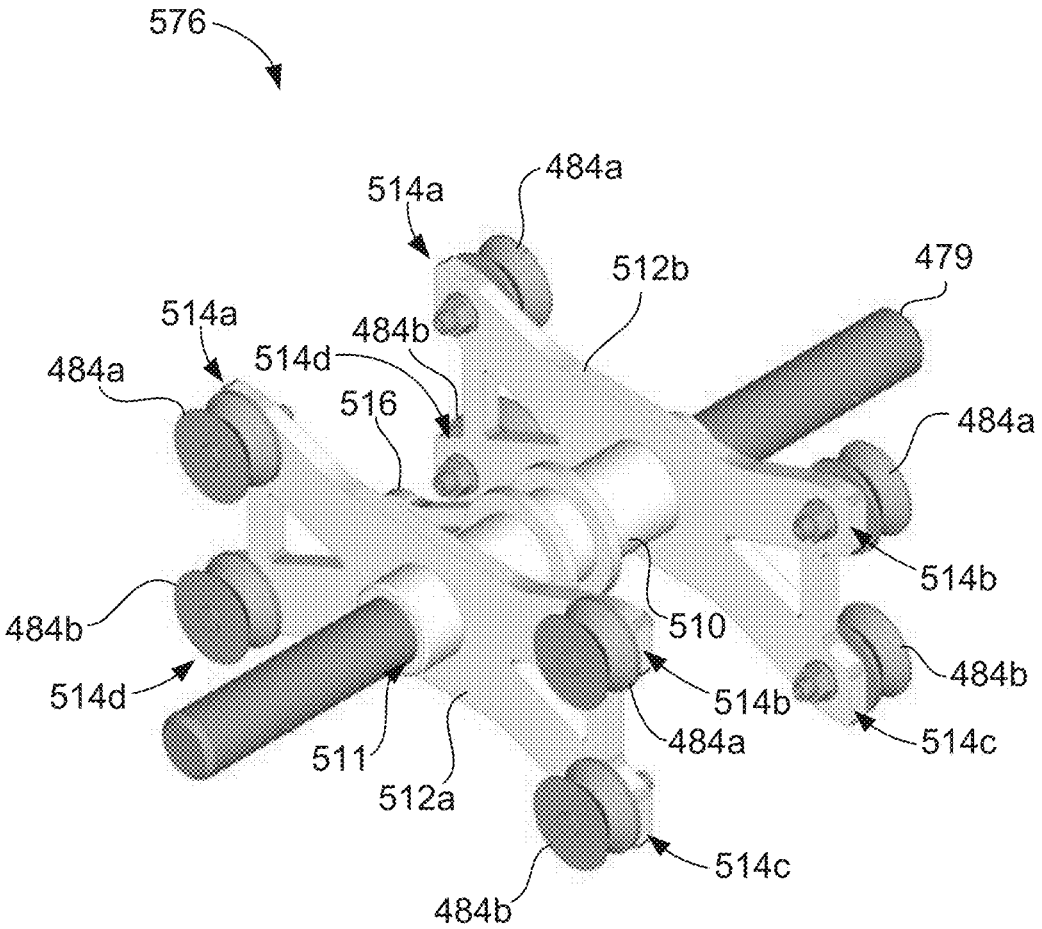
FIG. 28 is an isolated and enlarged view of an example carriage cart of the floating pivot mechanism of FIG. 27.
Figure 29:
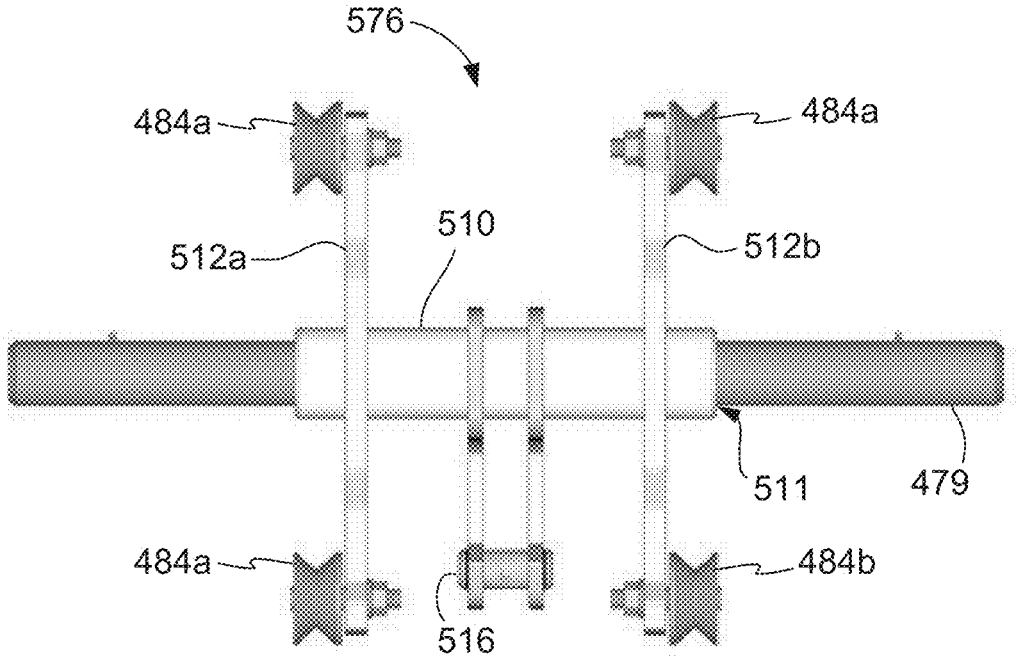
FIG. 29 is a top plan view of the carriage cart of FIG. 28.
Figure 30:
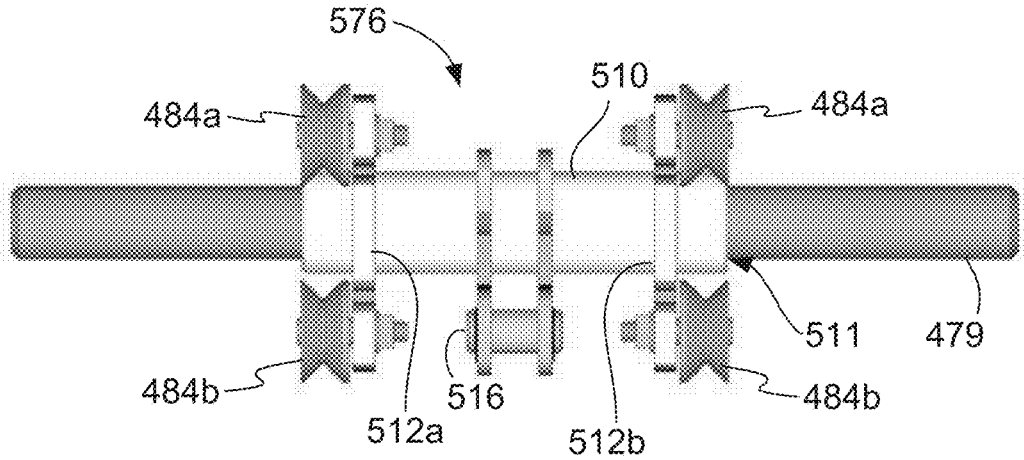
FIG. 30 is a side elevation view of the carriage cart of FIGS. 28 and 29.

FIG. 28 is an isolated and enlarged view of the example carriage cart 476 and pin 479 of the floating pivot mechanism 428. FIGS. 29 and 30 are top plan and side elevation views, respectively, of the same.

The carriage cart 476 in this example comprises a central shaft 510 having a longitudinal passage or hole 511 extending therethough that receives the pivot pin 479. A bracket 516 is centrally located along the shaft 516 for connecting to the piston rod 494 of the hydraulic cylinder 490 (which acts as the carriage axial adjustment mechanism 430 in this embodiment).

Spaced apart on either side of the bracket 516 are first and second radially extending roller mounts 512*a* and 512*b*. The roller mounts 512*a* and 512*b* are each generally butterfly-shaped in this embodiment, each having four respective corners 514*a* to 514*d* (FIG. 28). An upper roller 484*a* is mounted at each of the upper corners 514*a* and 514*b* for engaging the upper carriage guide tracks 480*a* shown in FIG. 27. A lower roller 484*b* is mounted at each of the lower corners 514*c* and 514*d* for engaging the lower carriage guide tracks 480*b* shown in FIG. 27.

Figure 31:
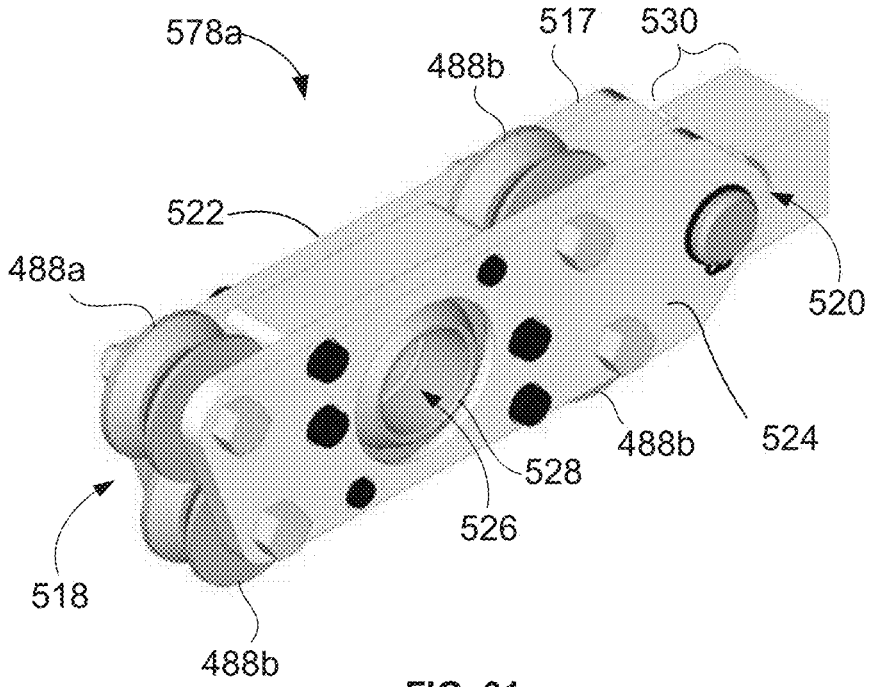
FIG. 31 is an isolated and enlarged perspective view of an example arm cart of the floating pivot mechanism of FIG. 27.
Figure 32:
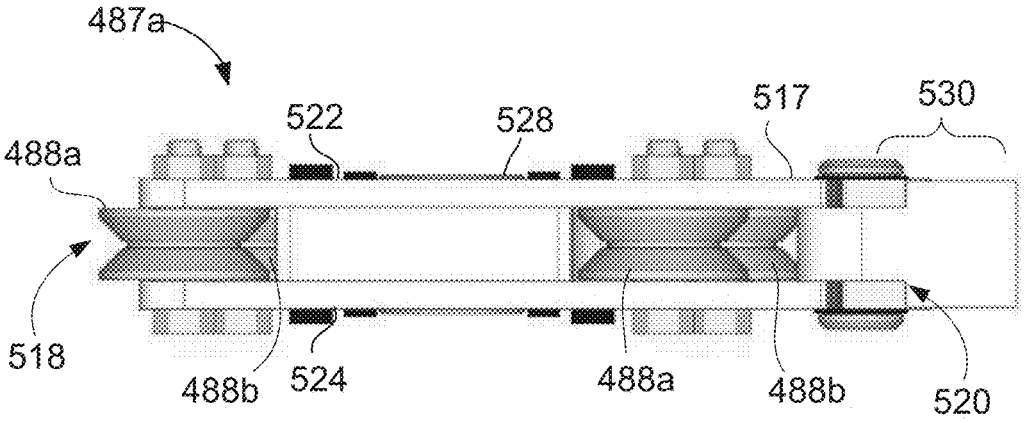
FIG. 32 is a top plan view of the arm cart of FIG. 31.
Figure 33:
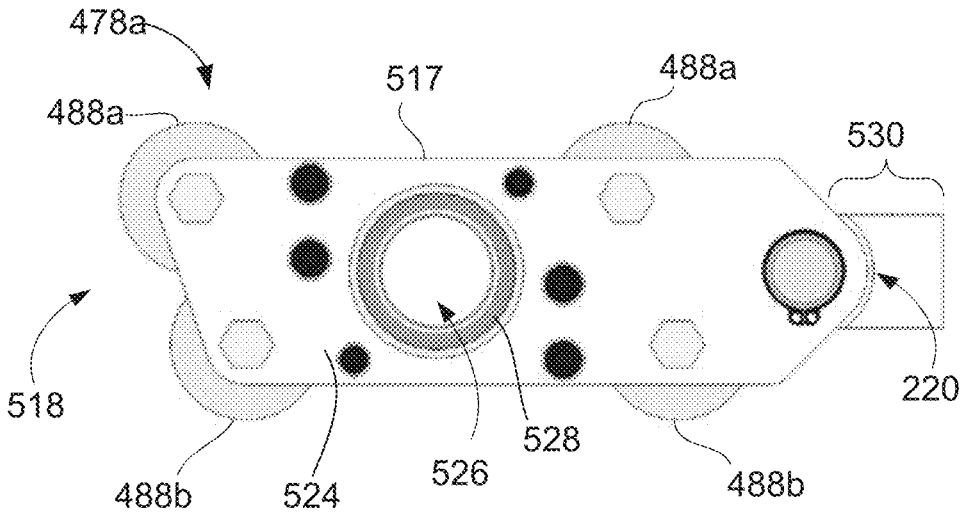
FIG. 33 is a side elevation view of the arm cart of FIGS. 31 and 32.

FIG. 31 is an isolated and enlarged perspective view of the example first arm cart 478*a* of the floating pivot mechanism 428. The second arm cart 478*b* has the same structure. FIGS. 32 and 33 are top plan and side elevation views, respectively, of the first arm cart 478*a*.

The arm cart 478 comprises a cart body 517 with a first end 518 and opposite second end 520. The first end 518 is a free end, and the second end 520 attaches to the hydraulic cylinder 500*a* or 500*b* (FIG. 27) functioning as the arm axial adjustment mechanism 432.

The arm cart 478 has a first side face 522 and opposite second side face 524, with a passage or hole 526 extending from the first side face 522 to the second side face 524 for receiving the pivot pin 479 (FIG. 27) therein. In this embodiment, a bushing 528 is positioned in the hole 526 and receives the pivot pin 479.

Two upper rollers 488*a* are mounted at an upper edge of the body 517 for engaging the upper arm guide tracks 486*a* shown in FIG. 27. Two lower rollers 488*b* are mounted at a lower edge of the body 517 for engaging the lower carriage guide tracks 486*b* shown in FIG. 27. The terms "upper" and "lower" in this context refer to the relative locations when the arm 420 is in the lowered position shown in FIGS. 26 and 27.

In this embodiment, a piston bracket 530 is pivotably connected to the body 517 at the second end 620 of the arm cart. The piston bracket is attachable to the piston rod 504*a* or 504*b* of the corresponding hydraulic cylinder 500*a* or 500*b* (to which the arm cart 478 is attached).

Figure 34:
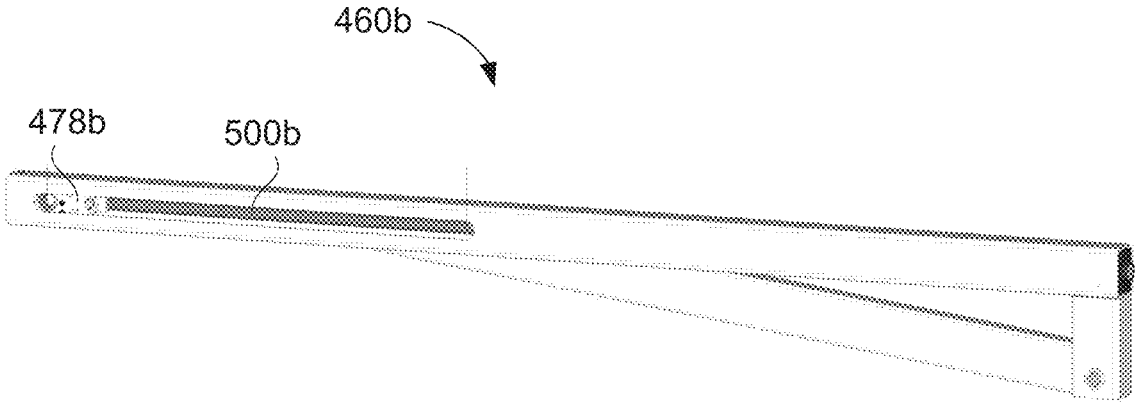
FIG. 34 is a side perspective view of a section of the lift arm of FIG. 26.
Figure 35:
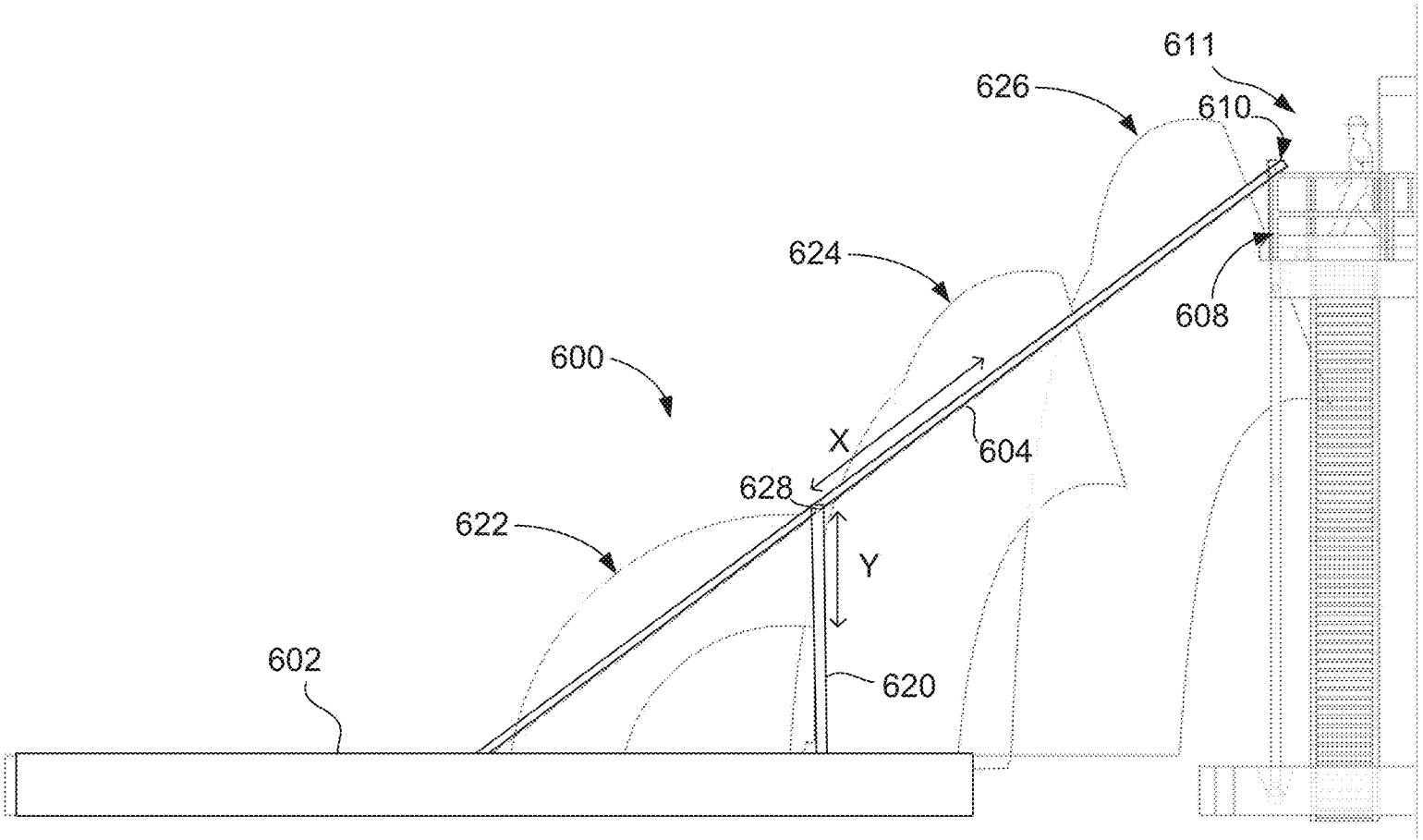
FIG. 35 is a side elevation view of an example tubular handling apparatus in a rig environment, illustrating example first and second order ranges of motion of the apparatus.

FIG. 34 is a side perspective view of the second arm section 460*b*, including the corresponding hydraulic cylinder 500*b* and arm cart 478*b* mounted within the main beam 464. A slot 440 in the side of the arm cart 478*b* provides clearance for the pivot connector (pin) 479 (shown in FIGS. 27 to 30).

Figure 36:
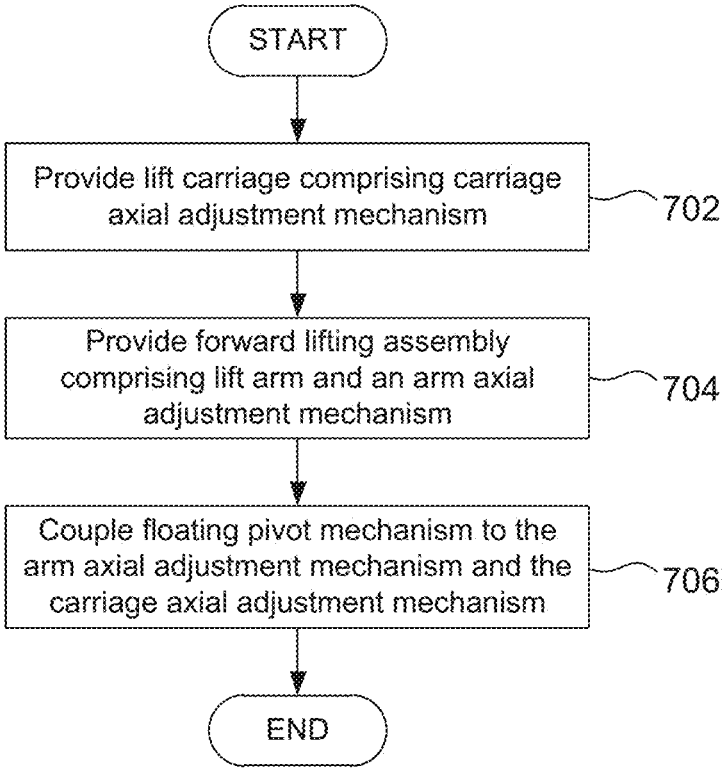
FIG. 36 is a flowchart of a method according to some embodiments.

The adaptability and movement that may be provided by the tubular handling apparatuses described herein is further illustrated in FIG. 36. FIG. 36 shows an example tubular handling apparatus 600 similar to the embodiments described above. An example rig 611 with an elevated rig floor 612 is also partially shown. The apparatus 600 comprises a base 602, lift carriage 604, and lift arm 620. The lift arm 620 is coupled to the lift carriage 604 by a floating pivot mechanism 628 that is actuatable for collinear movement along the longitudinal axes of the lift carriage 604 and lift arm 620 (similar to other embodiments described herein). A "first order" range of motion of the floating pivot mechanism 628 is shown in region 622. This "first order" region represents an example range of possible positions of the floating pivot mechanism 628 due to rotation of the lift arm 620 combined with extension and retraction of the lift arm 620 (indicated by arrow "Y").

The lift carriage 604 may move axially with respect to the floating pivot mechanism 628 (as indicated by arrow "X"). A first "second order" range of motion region 624 represents a possible range of motion of the forward end 610 of the lift carriage 604, due to the first order motion 622 when the lift carriage is in a rear-most position. A second "second order" range of motion region 626 represents a possible range of motion of the forward end 610 of the lift carriage 604, due to the first order motion 622 when the lift carriage is an extended, more forward position. Of course, the lift carriage 604 is not limited to these two "second order" regions, as the lift carriage may be moved and selectively positioned within the continuous range between its rear-most and forward-most positions.

In the embodiments described above, the lift carriage (104, 404) and forward lifting assembly (106, 406) are independently actuatable and adjustable within their respective ranges of motion. However, in other embodiments, movement or position of one of the lift carriage and forward lifting assembly may be dependent movement or position of the other. For example, the lift carriage and forward lifting assembly may have a master-slave relationship. In some embodiments, the lift carriage is the master, and the forward lifting assembly is the slave. The adjustment mechanisms (e.g. hydraulic lift cylinders) could be the same or similar as described above. However, instead of independent controls (e.g. hydraulic supplies) driving each adjustment mechanism, the arm axial adjustment mechanism may be moved or set in position as a function of movement or current position of the lift carriage. This may, for example, be implemented when the functions of the lift carriage and forward lifting assembly are collinear to each other (such as starting from the fully lowered position) and mechanically aligned to move together. In such scenarios, the "first order range of motion shown in FIG. 34 would not be a variable range region, but rather motion on an arc trajectory. However, the radius for this arc may not be constrained to a set number of pre-determined points. Rather, the art trajectory may have a "sliding scale" as the arm cart travel would reflect.

In one example, arm carts of the forward lifting assembly may be hydraulically or mechanically held in a longitudinal position (by cylinder/valves or rod locks etc.) until and after the lift arm has rotated a minimum threshold distance from the fully lowered position. In some embodiments, independent controls (e.g. hydraulic supplies) driving each adjustment mechanism are still used, but the control system (e.g. computer) is configured to restrict or actuate movement of one adjustment mechanism (e.g. carriage longitudinal, arm longitudinal, or arm rotation) responsive as a function of movement or position of another of the adjustment mechanisms.

FIG. 36 is a flowchart of a method for making a tubular handling apparatus as described herein, according to some embodiments.

At block 702, a lift carriage is provided having a carriage longitudinal axis and comprising a carriage axial adjustment mechanism operable to actuate movement parallel to the carriage longitudinal axis. The lift carriage may be in the form of the example lift carriages (104, 404) shown in the drawings and described above. The lift carriage may be supported by a base, such as the example base 102 shown in the drawings and described above. The carriage axial adjustment mechanism may comprise a telescoping actuator and may be hydraulically driven, such as the example hydraulic cylinders (190, 490) shown in the drawings and described above.

At block 704, a forward lifting assembly is provided comprising a lift arm and an arm axial adjustment mechanism operable to actuate movement parallel to the carriage longitudinal axis. The forward lifting assembly may be in the form of the example forward lifting assembly (106, 406) shown in the drawings and described above. The forward lifting assembly may interconnect the lift carriage and the base and be operable to lift a forward end of the lift carriage. The arm axial adjustment mechanism may comprise one or more telescoping actuator and may be hydraulically driven, such as the example hydraulic cylinders (200*a*, 200*b*, 500*a*, 500*b*) shown in the drawings and described above.

At block 706, a floating pivot mechanism is coupled to the arm axial adjustment mechanism operable and the carriage axial adjustment mechanism. The arm axial adjustment mechanism is, thus, operable to move the floating pivot mechanism substantially parallel to the arm longitudinal axis to adjust a distance between the floating pivot mechanism and the first arm end. The carriage axial adjustment mechanism is, thus, operable to move the lift carriage relative to the floating pivot mechanism and substantially parallel to the carriage longitudinal axis. The method may further comprise providing the floating pivot mechanism.

The arm and carriage adjustment mechanisms may be independently actuatable. In other embodiments, the movement of the arm adjustment mechanisms may be at least partially dependent on the movement of the carriage adjustment mechanism, or vice versa.

The forward lifting assembly may further comprise a rotation actuation mechanism. The method may further comprise pivotably coupling the lift arm and the rotation actuation mechanism to a base for actuating rotation of the lift arm relative to the base to lift the end of the lift carriage. The rotation actuation mechanism is independently actuatable.

The method may further comprise providing the base and/or mounting the lift carriage and/or forward lifting mechanism on the base. Mounting the forward lifting mechanism on the base may comprise pivotably connecting the lift arm to the base. Mounting the lift carriage on the base may comprise slidably engaging a rear end of the lift carriage to the base.

"Providing" the lift carriage, lift arm, floating pivot mechanism, base, and/or other components discussed above may comprise any means for obtaining the same, including, but not limited to: manufacturing, buying, importing and/or assembling such components.

Figure 37:
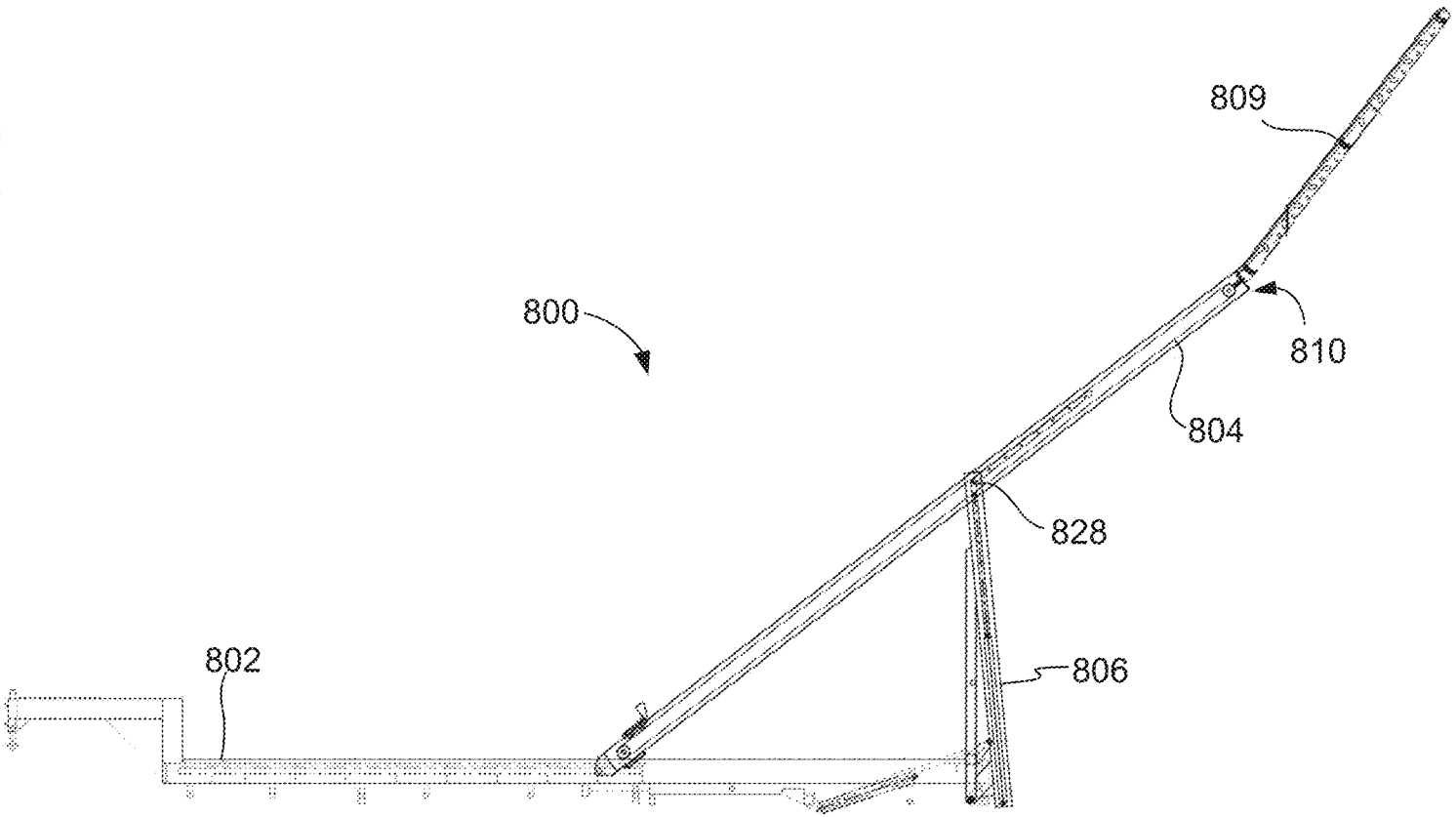
FIG. 37 is side elevation view of a pipe handling apparatus with a lift carriage extension according to some embodiments.

FIG. 37 is a side elevation view of another example tubular handling apparatus 800 that is similar to the other embodiments described herein. The apparatus 800 comprises a base 802, a lift carriage 804 supported by the base 802, a forward lifting assembly 806 that is pivotably connected to the base 802 and is also coupled to the lift carriage 804 by a floating pivot mechanism 828. The apparatus 800 has similar adjustment range of motion as the other embodiments described herein. However, the apparatus 800 in FIG. 37 has an extension 809 connected to the forward end 810 of the lift carriage 809. The extension 809 may be connected to the forward end 810 in any suitable manner (e.g. bolted). The extension 809 extends the effective length of the lift carriage 804 and allows pipe sections (or other tubulars) to be conveyed to greater vertical and/or horizontal locations. The angle of the extension 809 with respect to the lift carriage 804 may be adjustable in some embodiments. The extension 809 may be removable and/or replaceable. Similar extensions may be included in the other embodiments described herein.

In some embodiments, the a carriage and a forward lifting assembly, coupled by a floating pivot mechanism, described herein may be provided separately from a base, to be mounted on a base at another point in time. Thus, a pipe handling apparatus may be retrofitted to use the floating pivot mechanism described herein. For example, another type of lift carriage and forward lifting means may be removed from a base of a pipe lifting apparatus, and then the lift carriage, forward lifting mechanism and floating pivot mechanism as described herein may be mounted to the base. A lift carriage and forward lift arm may also be retrofitted with the carriage axial adjustment mechanism, arm axial adjustment mechanism and floating pivot mechanism described herein.

It is to be understood that a combination of more than one of the approaches described above may be implemented. Embodiments are not limited to any particular one or more of the approaches, methods or apparatuses disclosed herein. One skilled in the art will appreciate that variations, alterations of the embodiments described herein may be made in various implementations without departing from the scope of the claims.

The invention claimed is:

1. A tubular handling apparatus comprising:

a base;

a lift carriage supported by the base and having a carriage longitudinal axis, the lift carriage comprising a rear end and a forward end;

a forward lifting assembly comprising a lift arm for raising and lowering the forward end of the lift carriage, the lift arm having an arm longitudinal axis and comprising a first arm end pivotably connected to the base; and a floating pivot mechanism coupling the lift arm to the lift carriage;

the lift arm comprising an arm axial adjustment mechanism coupled to the floating pivot mechanism and operable to move the floating pivot mechanism substantially parallel to the arm longitudinal axis to adjust a distance between the floating pivot mechanism and the first arm end; and the lift carriage comprising: a first at least one guide track, wherein the floating pivot mechanism is slidably engaged with the first at least one guide track; and a carriage axial adjustment mechanism comprising an extending and retracting rod attached to the floating pivot mechanism and operable to move the lift carriage relative to the floating pivot mechanism and substantially parallel to the carriage longitudinal axis.

2. The tubular handling apparatus of claim 1, wherein:

the base has a base longitudinal axis; and the carriage longitudinal axis, the arm longitudinal axis, and the base longitudinal axis are substantially coplanar.

3. The tubular handling apparatus of claim 1, wherein the arm axial adjustment mechanism and the carriage axial adjustment mechanism are independently actuatable.

4. The tubular handling apparatus of claim 1, wherein the forward lifting assembly further comprises a rotation actuation mechanism to pivot the lift arm with respect to the base.

5. The tubular handling apparatus of claim 4, wherein the floating pivot mechanism comprises:

at least one lift carriage engaging element;

at least one lift arm engaging element; and a pivot connector coupling the at least one carriage engaging element and the at least one lift arm engaging element.

6. The tubular handling apparatus of claim 5, wherein the at least one lift carriage engaging element defines a passage therethrough in which the pivot connector is received.

7. The tubular handling apparatus of claim 5, wherein each at least one lift arm engaging element defines a respective passage therethrough in which the pivot connector is received.

8. The tubular handling apparatus of claim 5, wherein the first at least one guide track is substantially parallel to the carriage longitudinal axis, and wherein the at least one carriage engaging element comprises a carriage cart slidably engaged with the at least one carriage guide track.

9. The tubular handling apparatus of claim 5, wherein the at least one lift arm engaging element is slidably engaged with the lift arm and fixedly coupled to the arm axial adjustment mechanism.

10. The tubular handling apparatus of claim 9, wherein the lift arm further comprises a second at least one guide track that is substantially parallel with the arm longitudinal axis; wherein the at least one lift arm engaging element of the floating pivot mechanism comprises at least one lift arm cart slidably engaged with the second at least one guide track.

11. The tubular handling apparatus of claim 1, wherein:

the lift carriage comprises a rigid elongate structure; and the carriage axial adjustment mechanism and has a first end connected to the rigid elongate structure and a second end coupled to the floating pivot mechanism, the rod comprising the second end.

12. The tubular handling apparatus of claim 11, wherein the carriage axial adjustment mechanism comprises a hydraulic actuator.

13. The tubular handling apparatus of claim 1, wherein:

the lift arm comprises a rigid arm support structure;

the arm axial adjustment mechanism is expandable and retractable and has a first end connected to the arm support structure and a second end coupled to the floating pivot mechanism.

14. The tubular handling apparatus of claim 1, wherein at least one of the carriage axial adjustment mechanism and the arm axial adjustment mechanism each comprises a respective telescoping actuator.

15. The tubular handling apparatus of claim 4, further comprising a control system coupled to and operable to actuate the carriage axial adjustment mechanism, the arm axial adjustment mechanism, and the rotational adjustment mechanism.

16. The tubular handling apparatus of claim 15, wherein the control system comprises a processor that receives a selected position for the forward end of the lift carriage and calculates a configuration for at least one of the carriage axial adjustment mechanism, the arm axial adjustment mechanism, and the rotational adjustment mechanism as a function of the selected position.

17. The tubular handling apparatus of claim 16, wherein the control system actuates the at least one of the carriage axial adjustment mechanism, the arm axial adjustment mechanism, and the rotational adjustment mechanism in accordance with the calculated configuration.

18. A method comprising:

providing a lift carriage having a carriage longitudinal axis and comprising: a first at least one guide track; and a carriage axial adjustment mechanism comprising an extending and retracting rod operable to actuate movement parallel to the carriage longitudinal axis;

providing a forward lifting assembly comprising a lift arm, having an arm longitudinal axis, and an arm axial adjustment mechanism operable to actuate movement parallel to the carriage longitudinal axis; and coupling a floating pivot mechanism to the arm axial adjustment mechanism and the carriage axial adjustment mechanism, comprising slidably coupling the floating pivot mechanism to the first at least one guide track and attaching the floating pivot mechanism to the rod, such that:

the arm axial adjustment mechanism is operable to move the floating pivot mechanism substantially parallel to the arm longitudinal axis to adjust a distance between the floating pivot mechanism and the first arm end the carriage axial adjustment mechanism is operable to move the lift carriage relative to the floating pivot mechanism and substantially parallel to the carriage longitudinal axis.

19. The method of claim 18, wherein the forward lifting assembly further comprises a rotation actuation mechanism, and the method further comprises:

pivotably coupling the lift arm and the rotation actuation mechanism to a base for actuating rotation of the lift arm relative to the base to lift the end of the lift carriage.

20. A lift carriage system for a tubular handling apparatus comprising a base, the lift carriage system comprising:

a lift carriage supportable by the base and having a carriage longitudinal axis, the lift carriage comprising a rear end and a forward end;

a forward lifting assembly comprising a lift arm for raising and lowering the forward end of the lift carriage, the lift arm having a first arm end pivotably connectable to the base;

a floating pivot mechanism coupling the lift arm to the lift carriage;

the lift arm comprising an arm axial adjustment mechanism coupled to the floating pivot mechanism and operable to move the floating pivot mechanism substantially parallel to the arm longitudinal axis to adjust a distance between the floating pivot mechanism and the first arm end; and the lift carriage comprising: a first at least one guide track, wherein the floating pivot mechanism is slidably engaged with the first at least one guide track; and a carriage axial adjustment mechanism comprising an extending and retracting rod attached to the floating pivot mechanism and operable to move the lift carriage relative to the floating pivot mechanism and substantially parallel to the carriage longitudinal axis.

* * * * *